US010569563B2

(12) United States Patent
Nishio

(10) Patent No.: US 10,569,563 B2
(45) Date of Patent: Feb. 25, 2020

(54) PRINTER

(71) Applicant: BROTHER KOGYO KABUSHIKI KAISHA, Nagoya-shi, Aichi-ken (JP)

(72) Inventor: Akira Nishio, Kiyosu (JP)

(73) Assignee: BROTHER KOGYO KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 15/935,773

(22) Filed: Mar. 26, 2018

(65) Prior Publication Data

US 2018/0281445 A1 Oct. 4, 2018

(30) Foreign Application Priority Data

Mar. 30, 2017 (JP) ..... 2017-068910

(51) Int. Cl.

| | |
|---|---|
| ***B41J 2/18*** | (2006.01) |
| ***B41J 2/175*** | (2006.01) |
| ***B41J 29/02*** | (2006.01) |
| ***B41J 2/17*** | (2006.01) |

(52) U.S. Cl.

CPC ..... *B41J 2/18* (2013.01); *B41J 2/175* (2013.01); *B41J 2/1707* (2013.01); *B41J 2/17566* (2013.01); *B41J 29/02* (2013.01); *B41J 2002/17516* (2013.01); *B41J 2002/17573* (2013.01); *B41J 2002/17579* (2013.01)

(58) Field of Classification Search

CPC ..... B41J 2/18

See application file for complete search history.

(56) References Cited

U.S. PATENT DOCUMENTS

| | | | | |
|---|---|---|---|---|
| 6,511,153 | B1 | 1/2003 | Ishikawa | |
| 8,439,493 | B2 * | 5/2013 | Rosati | B41J 2/175 347/89 |
| 2005/0062815 | A1 * | 3/2005 | Yoshihira | B41J 2/1707 347/89 |
| 2005/0179715 | A1 * | 8/2005 | Merz | B41J 2/04515 347/17 |

(Continued)

FOREIGN PATENT DOCUMENTS

| | | |
|---|---|---|
| JP | H08-150730 A | 6/1996 |
| JP | H09-220816 A | 8/1997 |

(Continued)

OTHER PUBLICATIONS

Office Action issued in connection with related Japanese Application No. 2017-068910, dated Feb. 26, 2019. (9 pages).

(Continued)

*Primary Examiner* — Shelby L Fidler
(74) *Attorney, Agent, or Firm* — K&L Gates LLP

(57) ABSTRACT

A printer includes a first storage, a head, a first supply flow path, a first circulation flow path, a second supply flow path, and a second circulation flow path. The first storage is configured to be supplied with ink from a second storage, and is configured to store the supplied ink. The head configured to eject the ink. The first supply flow path merges with one of the second supply flow path and the second circulation flow path at one of a first connector and the first storage. The first circulation flow path merges with the other of the second supply flow path and the second circulation flow path at one of a second connector and the first storage.

13 Claims, 29 Drawing Sheets

(56) References Cited

U.S. PATENT DOCUMENTS

| | | | | |
|---|---|---|---|---|
| 2007/0279461 | A1* | 12/2007 | Hiratsuka | B41J 2/175<br>347/85 |
| 2011/0025738 | A1 | 2/2011 | Rosati et al. | |
| 2015/0251430 | A1 | 9/2015 | Ishii et al. | |
| 2017/0320331 | A1* | 11/2017 | Alessi | B41J 2/17596 |
| 2019/0092035 | A1* | 3/2019 | Hara | B41J 2/17596 |

FOREIGN PATENT DOCUMENTS

| | | | |
|---|---|---|---|
| JP | H11-042795 | A | 2/1999 |
| JP | 2001-071534 | A | 3/2001 |
| JP | 2005-022124 | A | 1/2005 |
| JP | 2007-216442 | A | 8/2007 |
| JP | 2012-187862 | A | 10/2012 |
| JP | 2012-529386 | A | 11/2012 |
| JP | 5742928 | B2 | 7/2015 |
| JP | 2015-168139 | A | 9/2015 |

OTHER PUBLICATIONS

Notification of Reasons for Rejection dated Jun. 4, 2019 in connection with Japanese Patent Application No. 2017-068910. (9 pages).

* cited by examiner

PRINTER

CROSS-REFERENCE TO RELATED APPLICATION

This application claims priority to Japanese Patent Application No. 2017-068910 filed on Mar. 30, 2017, the disclosure of which is herein incorporated by reference in its entirety.

BACKGROUND

The present disclosure relates to a printer.

A printer is known in which ink in a bottom portion of a main tank is circulated in order of a second ink supply path, a first ink supply path, and an ink circulation path.

SUMMARY

However, in the known printer, between a sub pouch and the main tank, a flow path exists in which the ink is not circulated. Thus, in the flow path in which the ink is not circulated, there is a possibility that components of the ink may settle, resulting in a deterioration in print quality.

Various embodiments of the general principles described herein provide a printer that reduces a possibility of a deterioration in print quality.

Embodiments herein provide a printer including a first storage, a head, a first supply flow path, a first circulation flow path, a second supply flow path, and a second circulation flow path. The first storage is configured to be supplied with ink from a second storage that stores the ink, and is configured to store the supplied ink. The head is configured to eject the ink supplied from the first storage. The first supply flow path is configured to supply the ink from the second storage to the first storage. The first circulation flow path is configured to circulate the ink from the first storage to the second storage. The second supply flow path is configured to supply the ink from the first storage to the head. The second circulation flow path is configured to circulate the ink from the head to the first storage. The first supply flow path merges with one of the second supply flow path and the second circulation flow path at one of a first connector and the first storage. The first circulation flow path merges with the other of the second supply flow path and the second circulation flow path at one of a second connector and the first storage.

Embodiments herein provide a printer including a first storage, a head, a first supply flow path, a first circulation flow path, a second supply flow path, a second circulation flow path, a bypass flow path, a processor, and a memory. The first storage is configured to be supplied with ink from a second storage portion that stores the ink, and is configured to store the supplied ink. The head is configured to eject the ink supplied from the first storage. The first supply flow path is configured to supply the ink from the second storage to the first storage. The first circulation flow path is configured to circulate the ink to the second storage. The second supply flow path is configured to supply the ink from the first storage to the head. The second circulation flow path is configured to circulate the ink from the head. The bypass flow path is configured to connect the second supply flow path and the second circulation flow path. The memory stores computer-readable instructions which, when executed by the processor, simultaneously perform the processes. The processes include second storage circulation via the second storage, the first supply flow path, and the first circulation flow path. The processes include head circulation via the head, the second supply flow path, the second circulation flow path, and the bypass flow path.

BRIEF DESCRIPTION OF THE DRAWINGS

Embodiments will be described below in detail with reference to the accompanying drawings in which.

DETAILED DESCRIPTION

An overview of a printer 1 will be explained with reference to FIG. 1. The upper side, the lower side, the lower left side, the upper right side, the lower right side and the upper left side of FIG. 1 are, respectively, the upper side, the lower side, the front side, the rear side, the right side and the left side of the printer 1.

The printer 1 is an inkjet printer that performs printing by ejecting an ink 68 (refer to FIG. 2) from nozzles of a head portion 67 (refer to FIG. 2) onto a print medium including a cloth such as a T shirt, paper or the like. For example, the printer 1 prints a color image on the print medium by downwardly ejecting five mutually different types of the ink 68 (white (W), black (K), yellow (Y), cyan (C), and magenta (M)). In the following explanation, of the five types of the ink 68, the white ink 68 is referred to as white ink, and when the four colors of the black, cyan, yellow and magenta inks 68 are collectively referred to as color inks. The white ink is an ink that is more prone to sedimentation than are the color inks.

Figure 1:
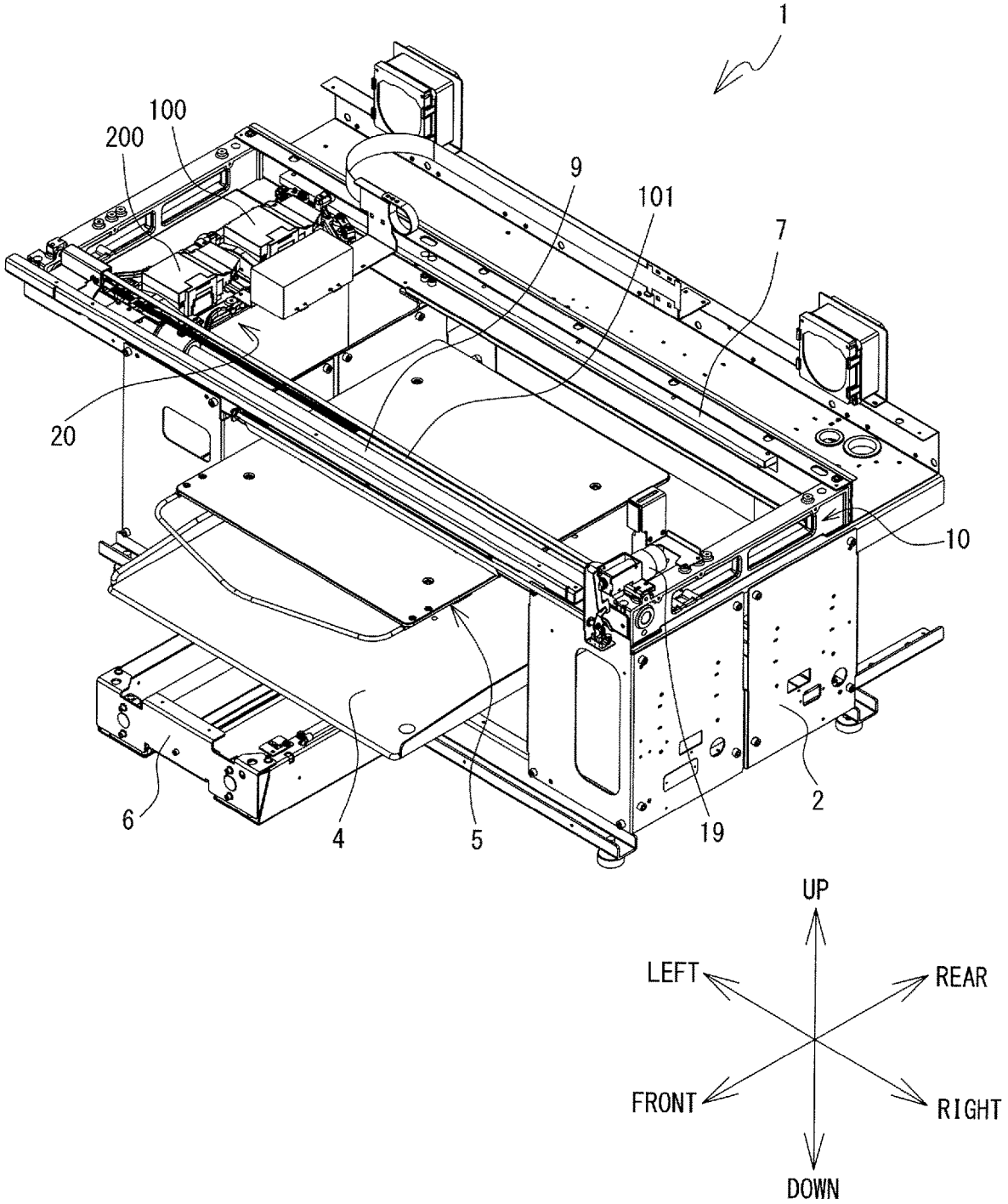
FIG. 1 is a perspective view of a printer.

As shown in FIG. 1, the printer 1 is provided with a housing 2, a platen drive mechanism 6, a pair of guide rails (not shown in the drawings), a platen 5, a tray 4, a frame body 10, a guide shaft 9, a rail 7, a carriage 20, head units 100 and 200, a drive belt 101, and a drive motor 19.

An operation portion (not shown in the drawings) that is used to operate the printer 1 is provided in a position on the front right side of the housing 2. The operation portion is used by an operator to input commands relating to various operations of the printer 1.

The frame body 10 is a frame shape that has a substantially rectangular shape in a plan view, and is placed on an upper portion of the housing 2. The frame body 10 respectively supports the guide shaft 9 on the front side of the frame body 10 and the rail 7 on the rear side of the frame body 10. The guide shaft 9 extends in the left-right direction inside the frame body 10. The rail 7 is provided such that the rail 7 faces the guide shaft 9 and extends in the left-right direction.

The carriage 20 is supported such that the carriage 20 can be conveyed along the guide shaft 9 in the left-right direction. The head units 100 and 200 are mounted on the carriage 20 so as to be aligned in the front-rear direction. The head unit 100 is positioned further to the rear than the head unit 200. A head portion 67 (refer to FIG. 2) is provided on a lower portion of each of the head units 100 and 200. The head portion 67 of the head unit 100 ejects the white ink. The head portion 67 of the head unit 200 ejects the color inks. Each of the head portions 67 is provided with a surface that has a plurality of minute nozzles (not shown in the drawings) capable of ejecting the ink 68 downward.

Figure 2:
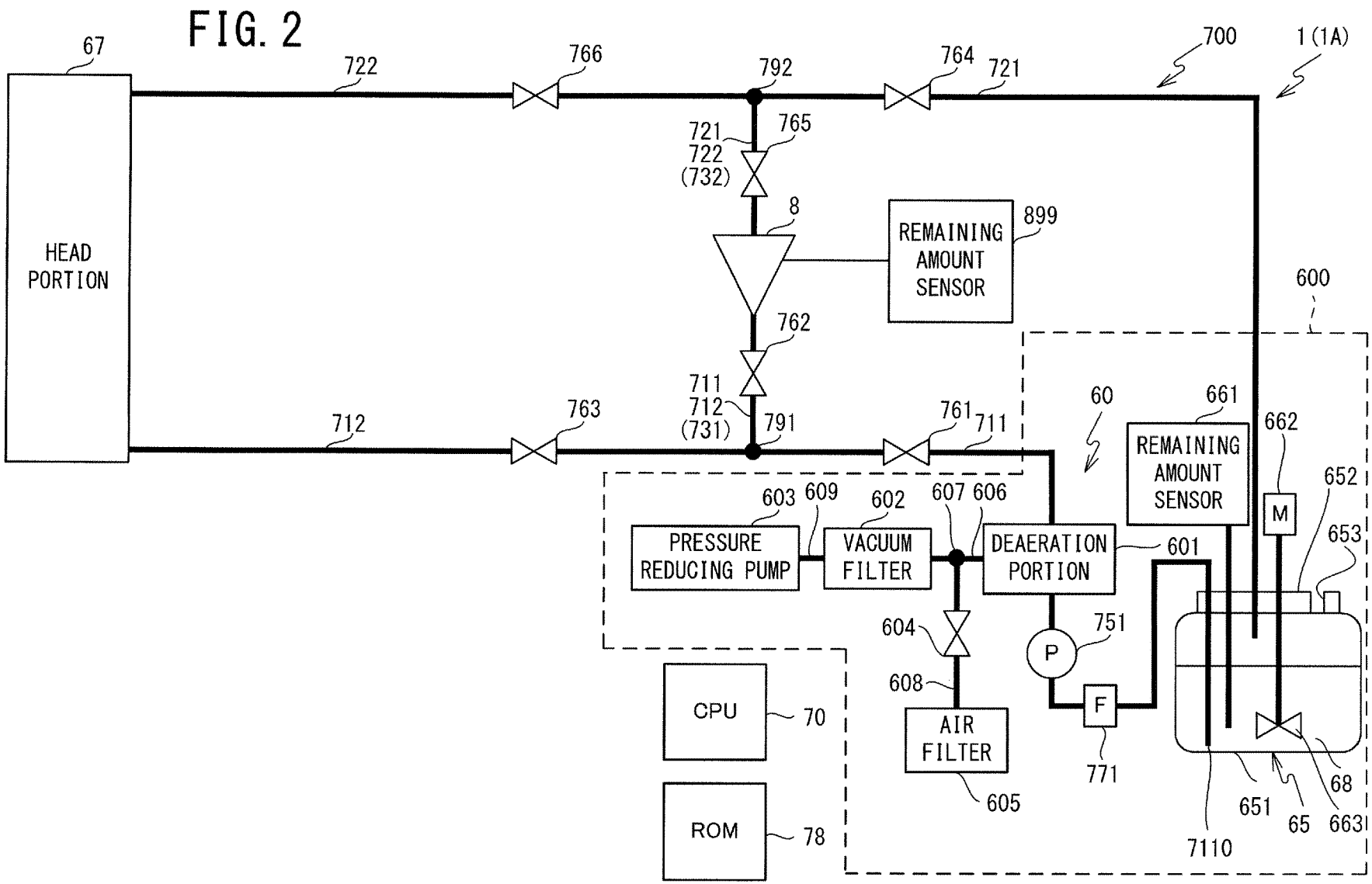
FIG. 2 is a diagram of flow paths of ink in the printer.

As shown in FIG. 2, the head portion 67 of the head unit 100 is connected to a main tank 65 that stores the white ink. The head portion 67 of the head unit 200 is connected to the main tanks 65 that store the color inks corresponding to each of the colors.

As shown in FIG. 1, the drive belt 101 is stretched along the left-right direction on the inside of the frame body 10. The drive motor 19 is coupled to the carriage 20 via the drive belt 101. By the drive motor 19 driving the drive belt 101, the carriage 20 is moved reciprocatingly in the left-right direction along the guide shaft 9.

The platen drive mechanism 6 is provided with the pair of guide rails (not shown in the drawings) and a platen support base (not shown in the drawings). The pair of guide rails extend in the front-rear direction inside the platen drive mechanism 6, and support the platen support base such that the platen support base can move in the front-rear direction. The platen support base supports the platen 5 at an upper portion of the platen support base. The platen 5 supports the print medium.

The tray 4 is provided below the platen 5. The tray 4 receives the sleeves of the T-shirt and the like when the operator places the T-shirt or the like on the platen 5. In this way, the tray 4 protects the sleeves and the like so as not to come into contact with other components inside the housing 2.

The platen drive mechanism 6 is driven by a sub scanning drive portion (not shown in the drawings) and moves the platen support base and the platen 5 in the front-rear direction along the pair of guide rails. The printing is performed on the print medium by the printer 1 as a result of the platen 5 transporting the print medium in the front-rear direction (a sub scanning direction), and the ink 68 being ejected from the head portions 67 that are reciprocating in the left-right direction (a main scanning direction).

A printer 1A that is an example of the printer 1 according to a first embodiment will be explained with reference to FIG. 2 to FIG. 6. FIG. 2 shows an example of flow paths through which one color of the ink 68 flows. Flow paths through which the other four colors of the inks 68 flow are the same as that shown in FIG. 2.

As shown in FIG. 2, the printer 1A is provided with a CPU 70, a ROM 78, a remaining amount sensor 661, a remaining amount sensor 899, a rotating portion 663, a motor 662, an ink supply portion 700, and the head portion 67. Further, the printer 1A is connected to the main tank 65. The CPU 70 controls the printer 1A in accordance with a program. The ROM78 stores the program and the like that is performed by the CPU70. The main tank 65 stores the ink 68. An amount that can be stored in the main tank 65 is greater than an amount that can be stored in a sub pouch 8 that will be described later.

The main tank 65 is provided with a container 651 and a lid 652. The container 651 is a member that stores the ink 68. A container opening and a lid opening, which are open portions, are provided in the upper portion of the container 651. The container opening is closed by the lid 652. The lid opening is closed by a lid 653. When the main tank 65 is replenished with the ink 68, the lid 653 is opened and the ink 68 is supplied into the container 651 from the lid opening.

The remaining amount sensor 661 is mounted on the main tank 65. The remaining amount sensor 661 outputs, to the CPU 70, a signal indicating a remaining amount of the ink 68 stored in the main tank 65. On the basis of the signal outputted by the remaining amount sensor 661, the CPU 70 detects the remaining amount of the ink 68 in the main tank 65. The remaining amount sensor 661 may be provided with electrodes that pass through the lid 652, or may be an optical sensor that has a light emitting portion provided on the outside of the container 651.

The rotating portion 663 is provided inside the container 651. The rotating portion 663 is provided in a position such that the rotating portion 663 can be disposed in the ink 68 inside the container 651. The motor 662 rotates the rotating portion 663 in accordance with the control of the CPU 70. When the rotating portion 663 rotates, the ink 68 stored in the main tank 65 is agitated. In this way, it is possible to reduce the possibility of sedimentation of the components of the ink 68 in the main tank 65.

The ink supply portion 700 is a portion through which the ink 68 flows and supplies the ink 68 to the head portion 67 and the like. The ink supply portion 700 is provided with the sub pouch 8, a first supply flow path 711, a second supply flow path 712, a first circulation flow path 721, a second circulation flow path 722, a first connecting flow path 731, a second connecting flow path 732, electromagnetic valves 761, 762, 763, 764, 765, and 766, a filter 771, a pump 751, and a deaeration module 60.

The sub pouch 8 is bag shaped and stores the ink 68 supplied from the main tank 65. The sub pouch 8 supplies the ink 68 to the head portion 67. The head portion 67 ejects the ink 68 supplied from the sub pouch 8 and performs printing on the print medium.

The remaining amount sensor 899 is mounted on the sub pouch 8. The remaining amount sensor 899 outputs, to the CPU 70, a signal indicating a remaining amount of the ink 68 stored in the sub pouch 8. On the basis of the signal outputted by the remaining amount sensor 899, the CPU 70 detects the remaining amount of the ink 68 in the sub pouch 8. The remaining amount sensor 899 may be provided with a similar configuration to the remaining amount sensor 661.

The first supply flow path 711, the second supply flow path 712, the first circulation flow path 721, the second circulation flow path 722, the first connecting flow path 731, and the second connecting flow path 732 are, for example, formed by hollow tubes.

The first supply flow path 711 is connected to the main tank 65 and the sub pouch 8, and is a flow path that supplies the ink 68 from the main tank 65 to the sub pouch 8. An end portion 7110 of the first supply flow path 711 on the main tank 65 side is provided in a position such that the end portion 7110 can be disposed inside the liquid of the ink 68 stored in the main tank 65.

The second supply flow path 712 is connected to the sub pouch 8 and the head portion 67 and is a flow path that supplies the ink 68 from the sub pouch 8 to the head portion 67. The first supply flow path 711 and the second supply flow path 712 merge at a first connection portion 791. The first connecting flow path 731 is a flow path between the first connection portion 791 and the sub pouch 8. In other words, the first connecting flow path 731 is a part of the first supply flow path 711 and is also a part of the second supply flow path 712.

The first circulation flow path 721 is connected to the main tank 65 and the sub pouch 8 and is a flow path that circulates the ink 68 from the sub pouch 8 to the main tank 65. The second circulation flow path 722 is connected to the head portion 67 and the sub pouch 8 and is a flow path that circulates the ink 68 from the head portion 67 to the sub pouch 8. The first circulation flow path 721 and the second circulation flow path 722 merge at a second connection portion 792. The second connecting flow path 732 is a flow path between the second connection portion 792 and the sub pouch 8. In other words, the second connecting flow path 732 is a part of the first circulation flow path 721 and is also a part of the second circulation flow path 722.

The electromagnetic valve 761 is provided in the first supply flow path 711. The electromagnetic valve 761 is positioned further to the side of the sub pouch 8 than a deaeration portion 601 that will be described later. The electromagnetic valve 761 is controlled by the CPU 70 and opens and closes the first supply flow path 711. The electromagnetic valve 762 is provided in the first connecting flow path 731. The electromagnetic valve 762 is controlled by the CPU 70 and opens and closes the first connecting flow path 731. The electromagnetic valve 763 is provided in the second supply flow path 712. The electromagnetic valve 763 is controlled by the CPU 70 and opens and closes the second supply flow path 712.

The electromagnetic valve 764 is provided in the first circulation flow path 721. The electromagnetic valve 764 is controlled by the CPU 70 and opens and closes the first circulation flow path 721. The electromagnetic valve 765 is provided in the second connecting flow path 732. The electromagnetic valve 765 is controlled by the CPU 70 and opens and closes the second connecting flow path 732. The electromagnetic valve 766 is provided in the second circulation flow path 722. The electromagnetic valve 766 is controlled by the CPU 70 and opens and closes the second circulation flow path 722.

The filter 771 is provided in the first supply flow path 711. The filter 771 eliminates foreign matter included in the ink 68 that flows through the first supply flow path 711.

The pump 751 is provided in the first supply flow path 711. The pump 751 is provided further to the sub pouch 8 side than the filter 771. The pump 751 sucks up the ink 68 from the main tank 65 and causes the ink 68 to flow toward the side of the sub pouch 8, which is further downstream.

The deaeration module 60 is provided in the first supply flow path 711. The deaeration module 60 is provided with the deaeration portion 601, a vacuum filter 602, a pressure reducing pump 603, an electromagnetic valve 604, an air filter 605, and channels 606, 608, and 609. The deaeration portion 601 is provided in the first supply flow path 711. The deaeration portion 601 is positioned between the pump 751 and the electromagnetic valve 761. The vacuum filter 602 is connected to the deaeration portion 601 via the channel 606. The channel 606 is connected to the channel 608 at a connection portion 607. The air filter 605 is connected to the channel 608. The electromagnetic valve 604 is provided in the channel 608. The pressure reducing pump 603 is connected to the vacuum filter 602 via the channel 609.

The pressure reducing pump 603 operates in accordance with the control of the CPU 70 and depressurizes the channel 606 via the vacuum filter 602. In this way, air bubbles included in the ink 68 flowing through the deaeration portion 601 decrease. When the channel 606 is depressurized, the electromagnetic valve 604 closes the channel 608 in accordance with the control of the CPU 70. When the channel 606 is not depressurized, the electromagnetic valve 604 opens the channel 608 in accordance with the control of the CPU 70. When the channel 608 is opened, atmospheric air is supplied to the channel 606 via the air filter 605 and the channel 606. In this way, the depressurized state of the channel 606 is released. The air filter 605 eliminates foreign matter from the atmospheric air flowing to the channel 608 side. Hereinafter, although not particularly referred to, it is assumed that when the ink 68 is flowing through the first supply flow path 711, the air bubbles are eliminated, by the deaeration module 60, from the ink 68 flowing through the first supply flow path 711.

In the following explanation, a configuration including the main tank 65, the deaeration module 60, the pump 751, the filter 771, the remaining amount sensor 661, the motor 662, and the rotating portion 663 is sometimes referred to as a tank system 600. In FIG. 3 to FIG. 6, some of the flow paths and the configuration of the tank system 600 are illustrated in a simplified manner, but the some of the flow paths and the configuration having the tank system 600 are the same as in the case shown in FIG. 2. The CPU 70 and the ROM78 is omitted in FIG. 3 to FIG. 6.

The flow of the ink 68 in the printer 1A will be explained. First, a case will be explained in which the sub pouch 8 is filled with the ink 68 from the main tank 65. In the following explanation, an operation of filling the sub pouch 8 with the ink 68 from the main tank 65 is referred to as "sub pouch filling".

Figure 3:
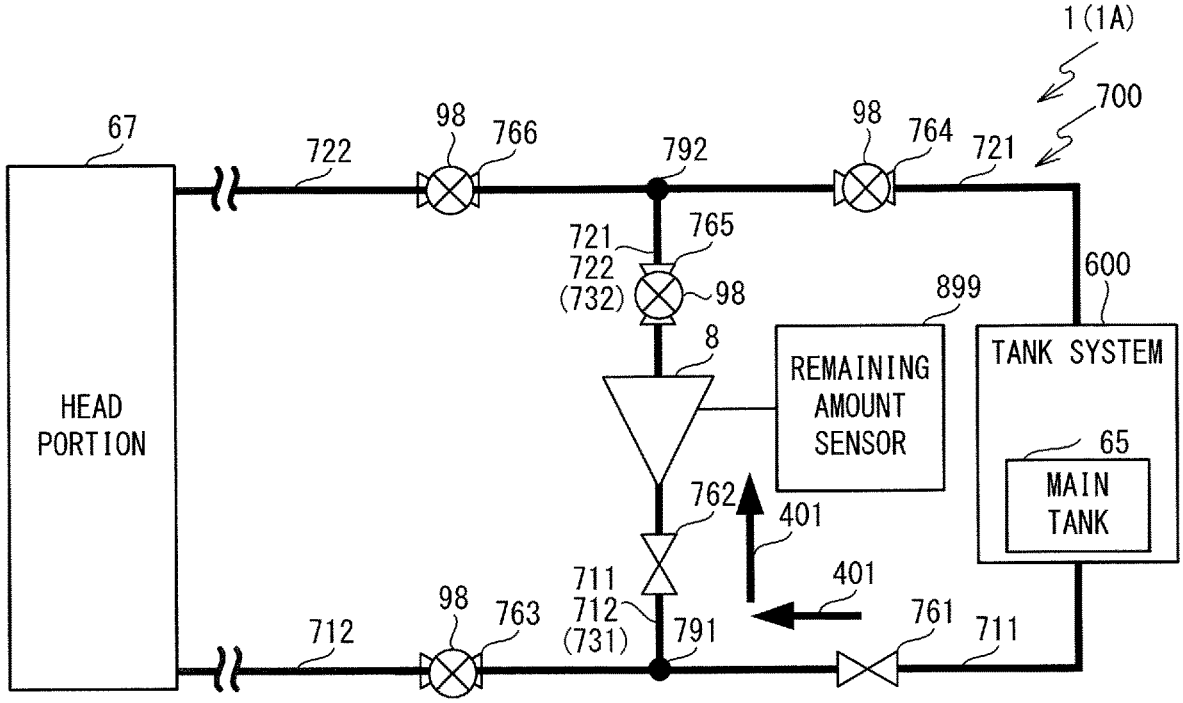
FIG. 3 is a diagram showing a state in which sub pouch filling is performed in the printer.

As shown in FIG. 3, when the sub pouch filling is performed, the CPU 70 opens the electromagnetic valve 761 and 762, and closes the electromagnetic valves 763, 764, 765, and 766. The pump 751 operates in accordance with the control of the CPU 70. In this way, the ink 68 stored in the main tank 65 is supplied to the sub pouch 8 via the first supply flow path 711 (refer to arrows 401). The supplied ink 68 is stored in the sub pouch 8. Below, although not particularly referred to, of the electromagnetic valves 761 to 766 present in the flow paths through which the ink 68 flows, for those electromagnetic valves that are closed, a mark 98 is marked in the drawings, indicating that the electromagnetic valves are closed.

Figure 4:
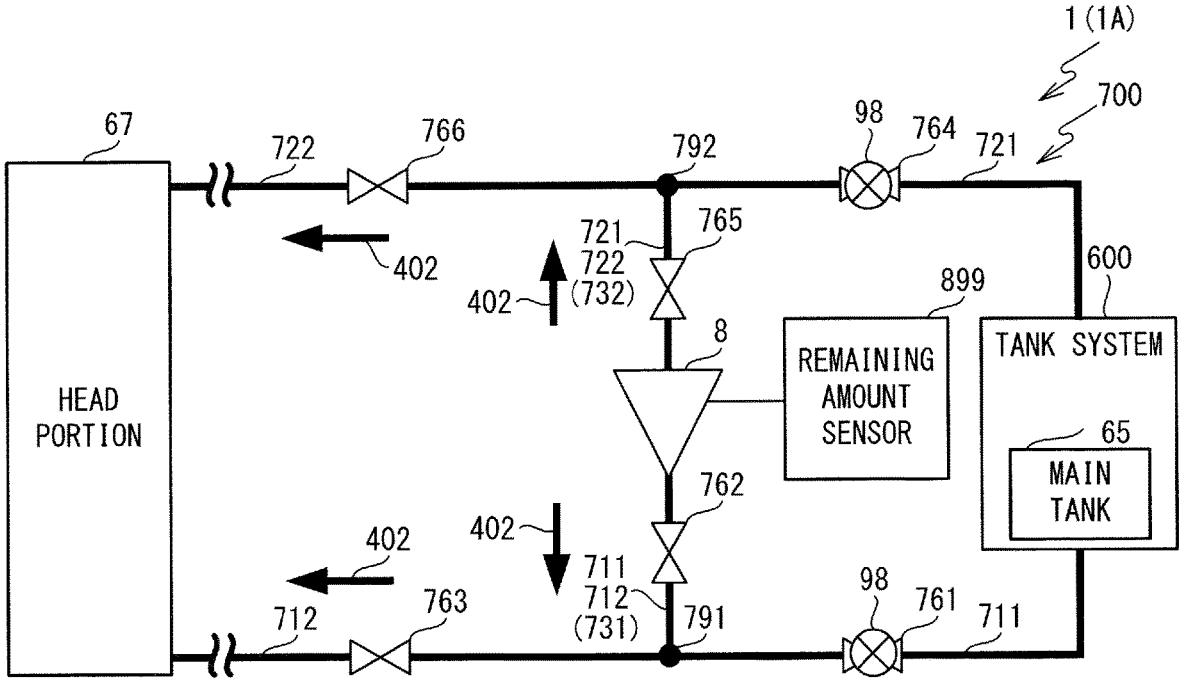
FIG. 4 is a diagram showing a state in which a print operation is performed in the printer.

With reference to FIG. 4, a case will be explained in which the printing is performed by ejecting the ink 68 from the head portion 67. In the following explanation, the operation to perform the printing by ejecting the ink 68 from the head portion 67 is referred to as a "print operation." When the print operation is performed, the CPU 70 opens the electromagnetic valves 762, 763, 765, and 766, and closes the electromagnetic valves 761 and 764. The operation to eject the ink 68 from the head portion 67 is performed in accordance with the control of the CPU 70. By the ink 68 being ejected from the head portion 67, the ink 68 stored in the sub pouch 8 is supplied to the head portion 67 via the second supply flow path 712 and the second circulation flow path 722 (refer to arrows 402).

Figure 5:
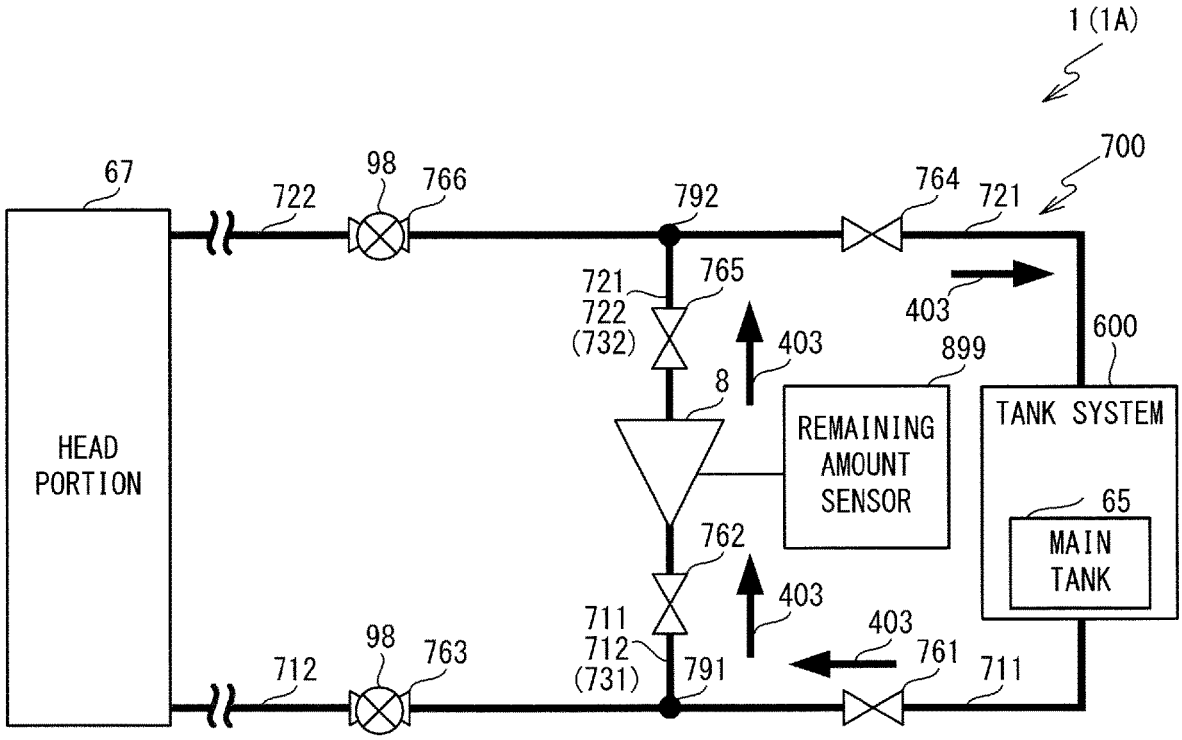
FIG. 5 is a diagram showing a state in which pouch-tank circulation is performed in the printer.

With reference to FIG. 5, a case will be explained in which the ink 68 is circulated between the sub pouch 8 and the main tank 65. In the following explanation, the circulation of the ink 68 between the sub pouch 8 and the main tank 65 is referred to as "pouch-tank circulation."

As shown in FIG. 5, when the pouch-tank circulation is performed, the CPU 70 opens the electromagnetic valves 761, 762, 764, and 765, and closes the electromagnetic valves 763 and 766. The pump 751 operates in accordance with the control of the CPU 70. In this way, the ink 68 is sucked up from the main tank 65, and then flows to the main tank 65 via the first supply flow path 711, the sub pouch 8, and the first circulation flow path 721 (refer to arrows 403). In this way, the ink 68 is circulated in the main tank 65, the first supply flow path 711, the sub pouch 8, and the first circulation flow path 721. In the pouch-tank circulation, the ink 68 is not supplied to the head portion 67, and the ink 68 is also not circulated from the head portion 67.

A case will be explained in which the ink 68 is circulated via the head portion 67 and the main tank 65. In the following explanation, the circulation of the ink 68 via the head portion 67 and the main tank 65 is referred to as "head-tank circulation."

Figure 6:
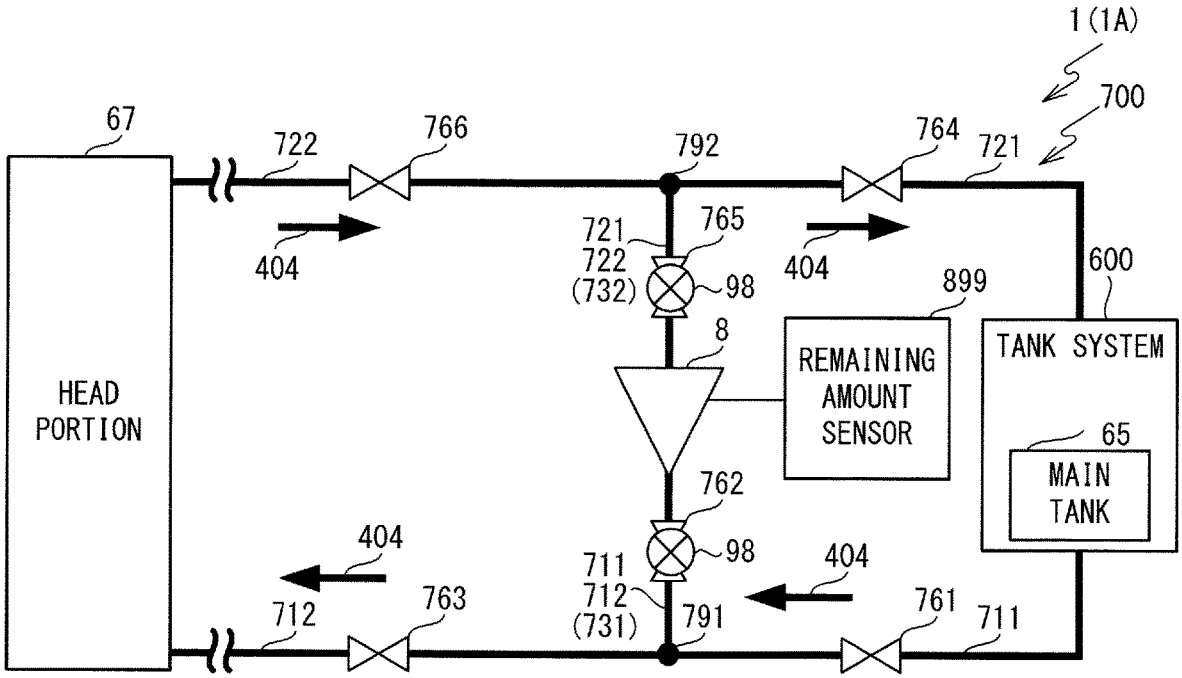
FIG. 6 is a diagram showing a state in which head-tank circulation is performed in the printer.

As shown in FIG. 6, when the head-tank circulation is performed, the CPU 70 opens the electromagnetic valves 761, 763, 764, and 766, and closes the electromagnetic valves 762 and 765. The pump 751 operates in accordance with the control of the CPU 70. In this way, the ink 68 is sucked up from the main tank 65, and then flows to the main tank 65 via the first supply flow path 711, the second supply flow path 712, the head portion 67, the second circulation flow path 722, and the first circulation flow path 721 (refer to arrows 404). In this way, the ink 68 is circulated in the main tank 65, the first supply flow path 711, the second supply flow path 712, the head portion 67, the second circulation flow path 722 and the first circulation flow path 721.

With reference to FIG. 6, a case will be explained in which the ink 68 is circulated between the head portion 67 and the sub pouch 8. In the following explanation, the circulation of the ink 68 between the head portion 67 and the sub pouch 8 is referred to as "head-pouch circulation." Although not shown in the drawings, when the head-pouch circulation is performed, the CPU 70 opens the electromagnetic valves 762, 763, 765, and 766 and closes the electromagnetic valves 761 and 764. A pump (not shown in the drawings) is provided in the second supply flow path 712 or the second circulation flow path 722. The pump operates in accordance with the control of the CPU 70. In this way, the ink 68 is circulated in the sub pouch 8, the second supply flow path 712, the head portion 67, and the second circulation flow path 722.

The ink 68 flows as described above in the printer 1A according to the first embodiment. In the first embodiment, the second supply flow path 712 and the first supply flow path 711 merge at the first connection portion 791. The second circulation flow path 722 and the first circulation flow path 721 merge at the second connection portion 792. By the flow paths being connected in this manner, the printer 1A performs the pouch-tank circulation and thus, the ink 68 can be circulated in the main tank 65, the first supply flow path 711, the sub pouch 8, and the first circulation flow path 721 (refer to FIG. 5). By performing the head-tank circulation, the printer 1A can circulate the ink 68 in the first supply flow path 711, the second supply flow path 712, the second circulation flow path 722, and the first circulation flow path 721 (refer to FIG. 6). Thus, the ink 68 can be circulated in all the flow paths, namely the first supply flow path 711, the second supply flow path 712, the first circulation flow path 721, and the second circulation flow path 722. As a result, in comparison to a case in which the ink 68 is not circulated in some of the flow paths, of the first supply flow path 711, the second supply flow path 712, the first circulation flow path 721, and the second circulation flow path 722, the possibility can be reduced of a deterioration in the print quality resulting from the sedimentation of the components of the ink 68.

As examples of deterioration in print quality, the following can be given. For example, there is a case in which a component of the ink 68 that has settled is not supplied to the head portion 67, and the color of the printing changes. There is a case in which the settled component blocks the flow path and the ink 68 does not flow freely, and the amount of ink 68 ejected from the head portion 67 decreases. Further, there is a case in which clogging occurs inside of the nozzle of the head portion 67 due to the settled component, and the ink 68 is not ejected from the nozzle. In particular, the white ink is more prone to sedimentation than are the color inks. Therefore in comparison to the color inks, there is a higher possibility that the print quality may deteriorate. In the first embodiment, the possibility of the print quality deteriorating, as in the above-described examples, can be reduced.

The electromagnetic valve 763 that opens and closes the second supply flow path 712 is provided in the second supply flow path 712. The electromagnetic valve 766 that opens and closes the second circulation flow path 722 is provided in the second circulation flow path 722. When the circulation of the ink 68 is performed in at least one of the main tank 65 and the sub pouch 8, namely, when the pouch-tank circulation is performed in the first embodiment, the electromagnetic valves 763 and 766 close the second supply flow path 712 and the second circulation flow path 722 (refer to FIG. 5). Thus, when the pouch-tank circulation is performed, the possibility is reduced that there is an impact on the head portion 67, such as a meniscus inside the nozzle of the head portion 67 breaking due to the influence of pressure resulting from the circulation, leaking of the ink 68 or the like. As a result, the print quality is improved.

Next, a printer 1B that is the printer 1 according to a second embodiment will be explained, with reference to FIG. 7 to FIG. 11. In the second embodiment, the same reference numerals are assigned to a configuration that is the same as that of the first embodiment, and a detailed explanation of the same configuration is omitted.

Figure 7:
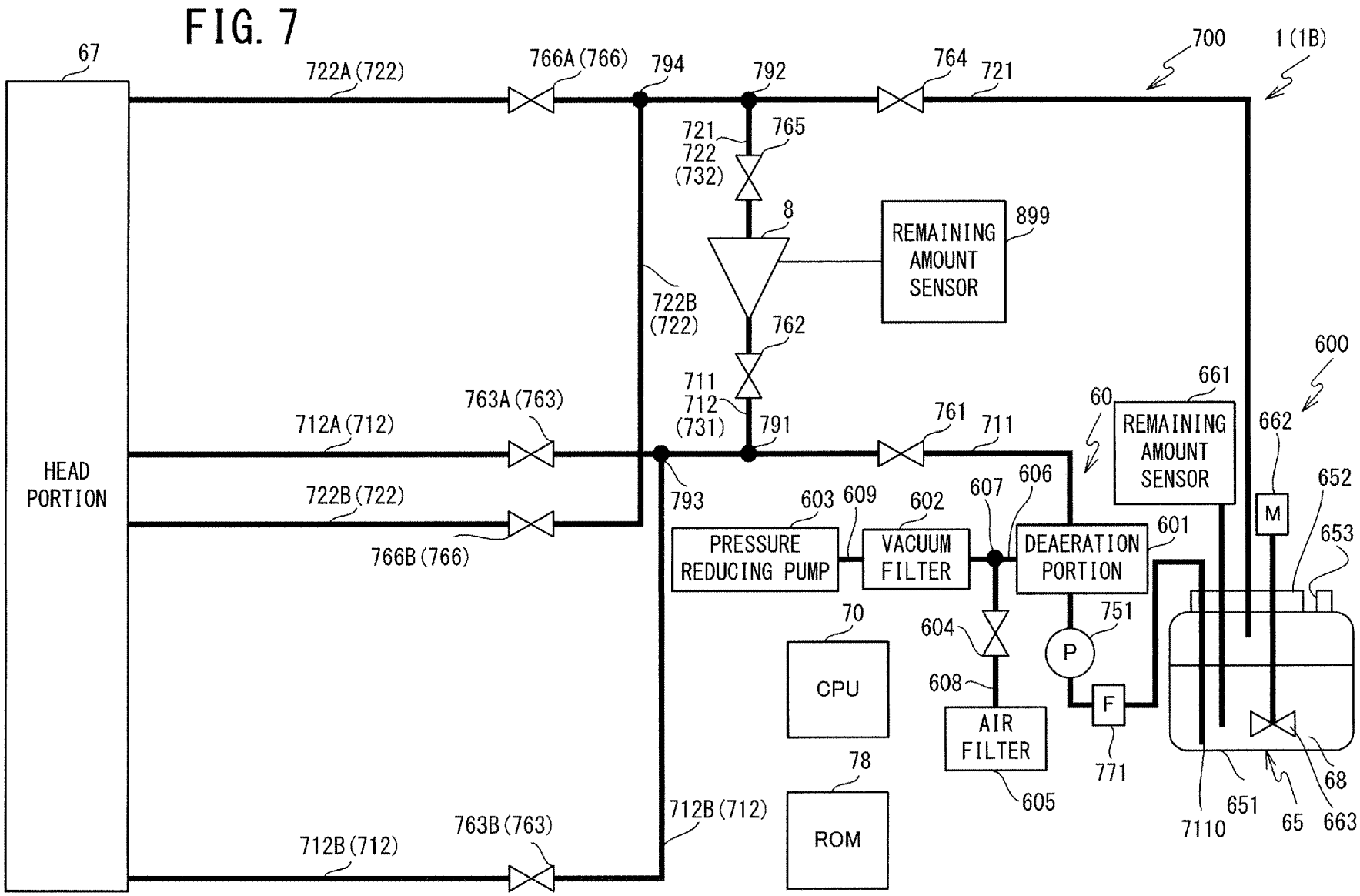
FIG. 7 is a diagram showing flow paths of the ink in the printer.
Figure 8:
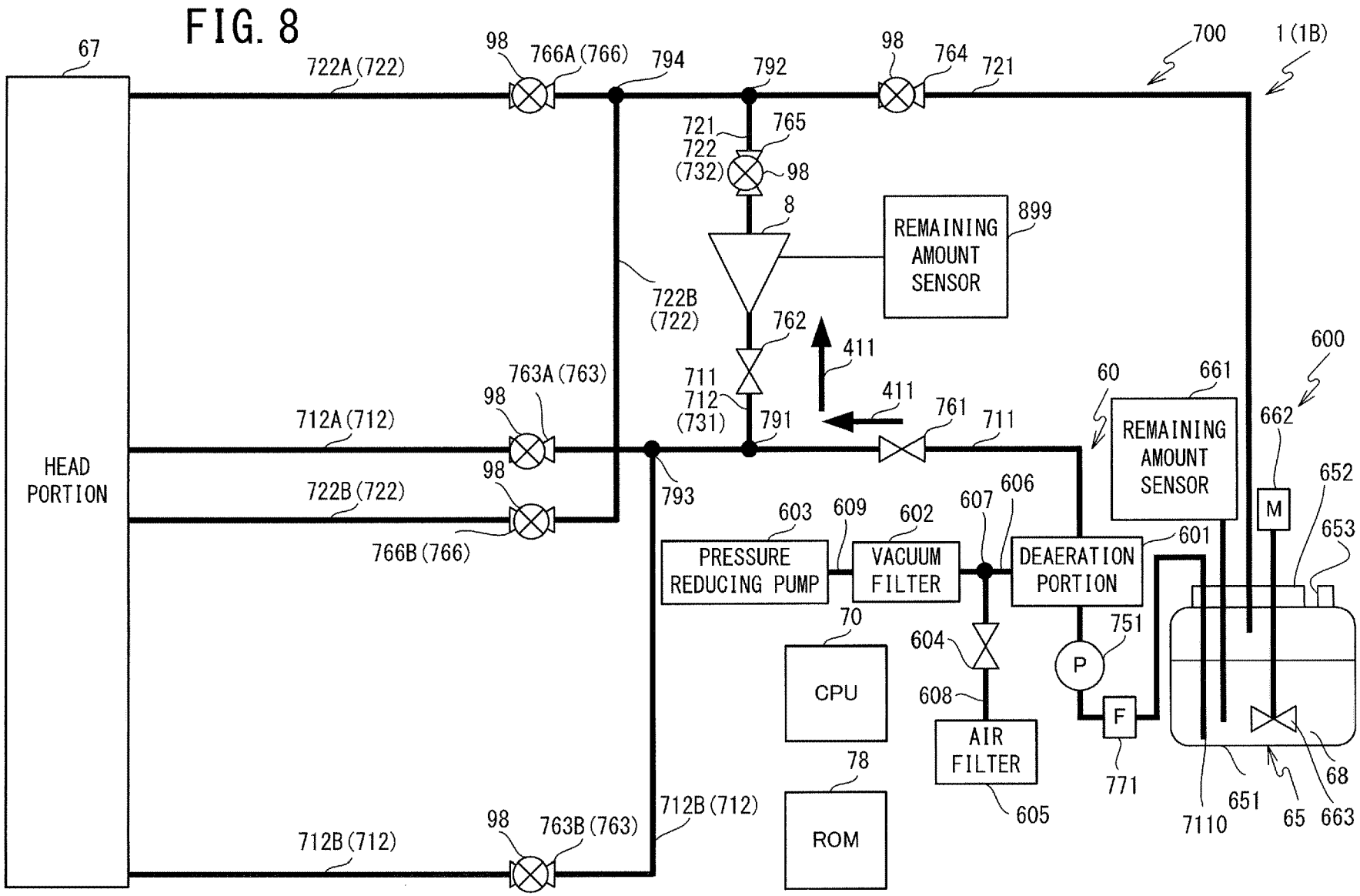
FIG. 8 is a diagram showing a state in which the sub pouch filling is performed in the printer.

As shown in FIG. 7, in the printer 1B, the second supply flow path 712 and the second circulation flow path 722 respectively branch into two flow paths. More specifically, the second supply flow path 712 is divided into a second supply flow path 712A and a second supply flow path 712B, at a third connection portion 793. The third connection portion 793 is positioned further to the head portion 67 side than the sub pouch 8 and the first connection portion 791. The second supply flow path 712A and the second supply flow path 712B are each connected to the head portion 67.

The electromagnetic valves 763 are respectively provided in the second supply flow path 712A and the second supply flow path 712B. In the following explanation, the electromagnetic valve 763 provided in the second supply flow path 712A is sometimes referred to as an electromagnetic valve 763A, and the electromagnetic valve 763 provided in the second supply flow path 712B is sometimes referred to as an electromagnetic valve 763B.

The second circulation flow path 722 is divided into a second circulation flow path 722A and a second circulation flow path 722B, at a fourth connection portion 794. The fourth connection portion 794 is positioned further to the head portion 67 side than the sub pouch 8 and the second connection portion 792. The second circulation flow path 722A and the second circulation flow path 722B are each connected to the head portion 67.

The electromagnetic valves 766 are respectively provided in the second circulation flow path 722A and the second circulation flow path 722B. In the following explanation, the electromagnetic valve 766 provided in the second circulation flow path 722A is sometimes referred to as an electromagnetic valve 766A, and the electromagnetic valve 766 provided in the second circulation flow path 722B is sometimes referred to as an electromagnetic valve 766B.

The flow of the ink 68 in the printer 1B will be explained, with reference to FIG. 8 to FIG. 11. A case will be explained in which the sub pouch filling is performed. When the sub pouch filling is performed, the CPU 70 opens the electromagnetic valves 761 and 762, and closes the electromagnetic valves 763A 763B, 764, 765, 766A, and 766B. The pump 751 operates in accordance with the control of the CPU 70. In this way, the ink 68 stored in the main tank 65 is supplied to the sub pouch 8 via the first supply flow path 711 (refer to arrows 411). The supplied ink 68 is stored inside the sub pouch 8. In the sub pouch filling, the ink 68 is not supplied to the head portion 67, and the ink 68 is also not circulated from the head portion 67.

Figure 9:
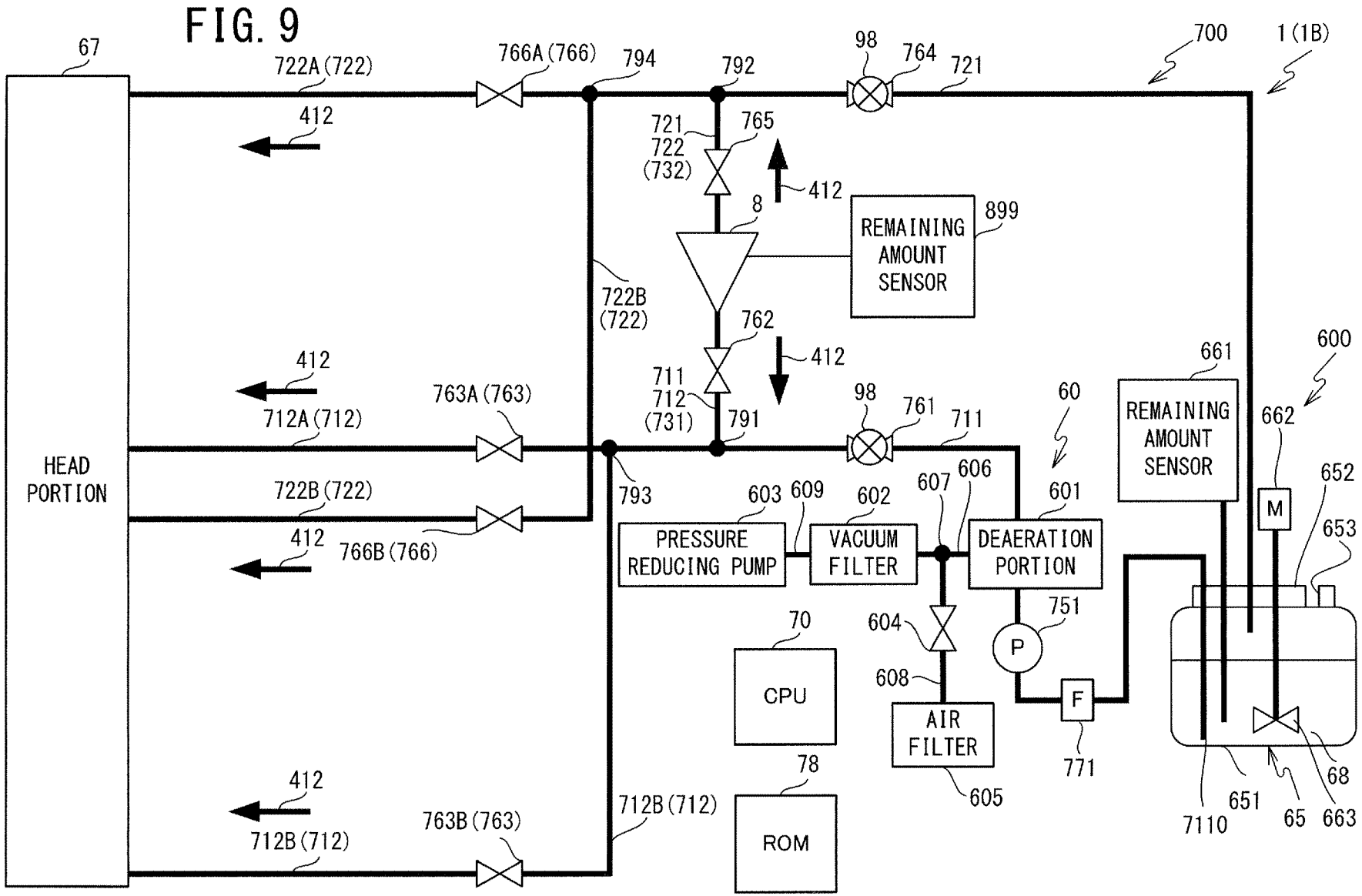
FIG. 9 is a diagram showing a state in which the print operation is performed in the printer.

A case will be explained in which the print operation is performed, with reference to FIG. 9. When the print operation is performed, the CPU 70 opens the electromagnetic valves 762, 763A, 763B, 765, 766A, and 766B, and closes the electromagnetic valves 761 and 764. In accordance with the control of the CPU 70, the operation is performed to eject the ink 68 from the head portion 67. By the ink 68 being ejected from the head portion 67, the ink 68 stored in the sub pouch 8 is supplied to the head portion 67 via the second supply flow paths 712A and 712B, and the second circulation flow paths 722A and 722B (refer to arrows 412). In the print operation, the ink 68 is not supplied from the main tank 65, and the ink 68 is not circulated to the main tank 65.

Figure 10:
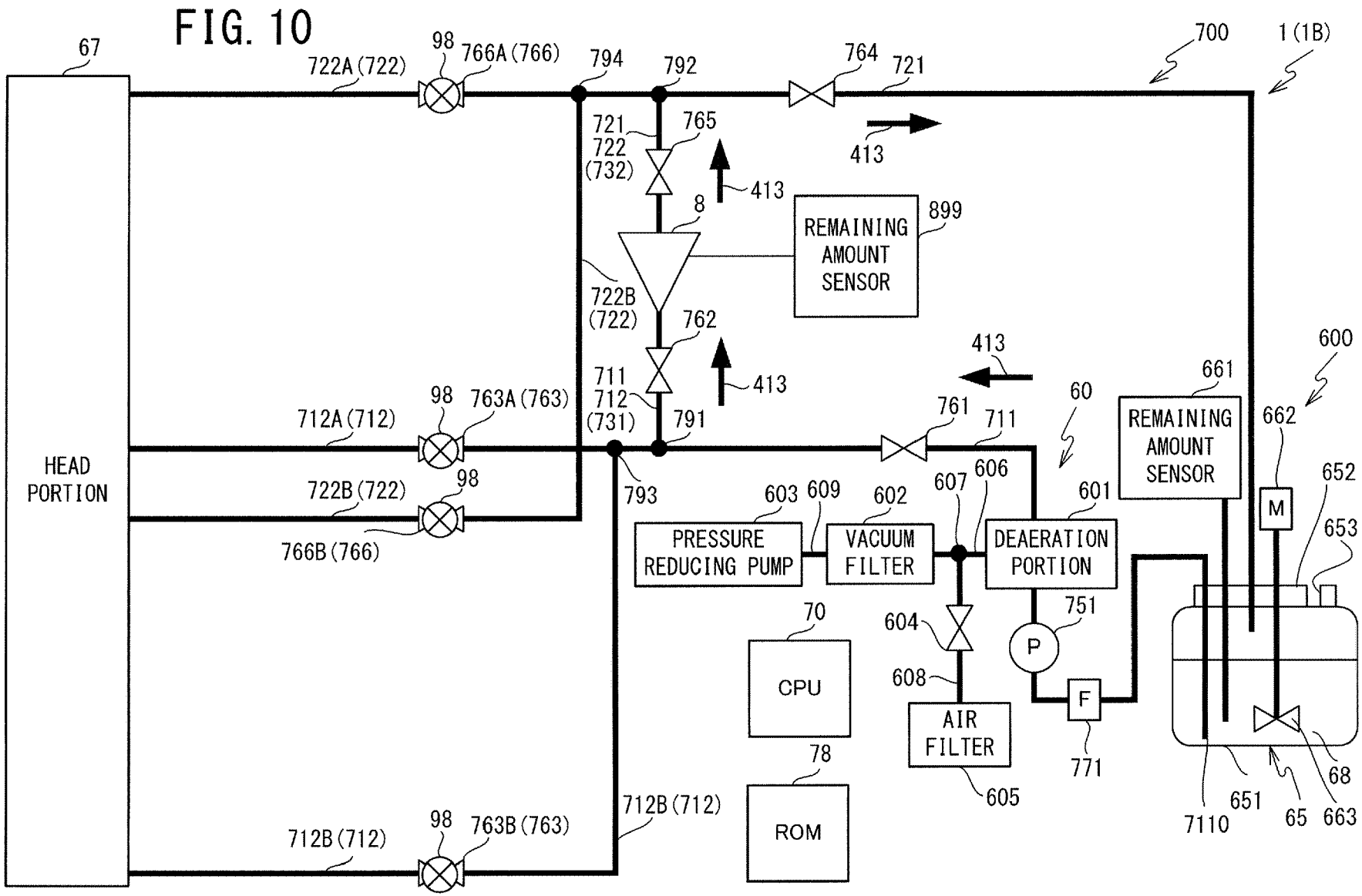
FIG. 10 is a diagram showing a state in which the pouch-tank circulation is performed in the printer.

A case will be explained in which the pouch-tank circulation is performed, with reference to FIG. 10. When the pouch-tank circulation is performed, the CPU 70 opens the electromagnetic valves 761, 762, 764, and 765, and closes the electromagnetic valves 763A, 763B, 766A, and 766B. The pump 751 operates in accordance with the control of the CPU 70. In this way, the ink 68 is sucked up from the main tank 65 and then flows to the main tank 65, via the first supply flow path 711, the sub pouch 8, and the first circulation flow path 721 (refer to arrows 413). In this way, the ink 68 is circulated in the main tank 65, the first supply flow path 711, the sub pouch 8, and the first circulation flow path 721. In the pouch-tank circulation, the ink 68 is not supplied to the head portion 67, and the ink 68 is not circulated from the head portion 67.

Figure 11:
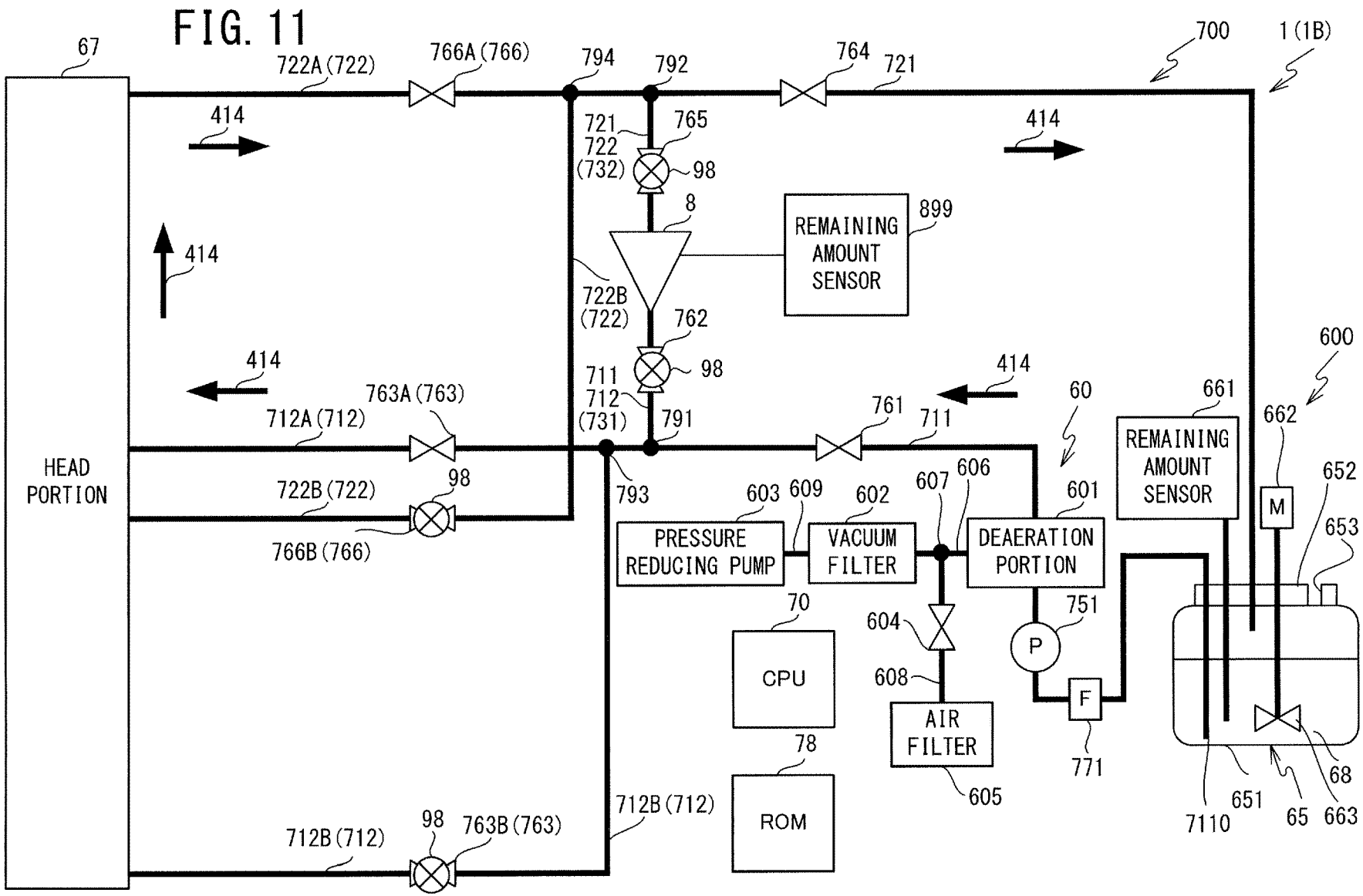
FIG. 11 is a diagram showing a state in which first head-tank circulation is performed in the printer.

A case will be explained in which the head-tank circulation is performed, with reference to FIG. 11. In the second embodiment, there is a case in which first head-tank circulation is performed (refer to FIG. 11), via the second supply flow path 712A, the head portion 67, and the second circulation flow path 722A, and a case in which second head-tank circulation is performed, via the second supply flow path 712B, the head portion 67, and the second circulation flow path 722B.

When the first head-tank circulation is performed, the CPU 70 opens the electromagnetic valves 761, 763A, 764, and 766A, and closes the electromagnetic valves 762, 763B, 765, and 766B. The pump 751 operates in accordance with the control of the CPU 70. In this way, the ink 68 is sucked up from the main tank 65 and then flows to the main tank 65, via the first supply flow path 711, the second supply flow path 712A, the head portion 67, the second circulation flow path 722A, and the first circulation flow path 721 (refer to arrows 414). In this way, the ink 68 is circulated in the main tank 65, the first supply flow path 711, the second supply flow path 712A, the head portion 67, the second circulation flow path 722A, and the first circulation flow path 721.

Although not shown in the drawings, when the second head-tank circulation is performed, the CPU 70 opens the electromagnetic valves 761, 763B, 764, and 766B, and closes the electromagnetic valves 762, 763A, 765, and 766A. The pump 751 operates in accordance with the control of the CPU 70. In this way, the ink 68 is sucked up from the main tank 65 and then flows to the main tank 65, via the first supply flow path 711, the second supply flow path 712B, the head portion 67, the second circulation flow path 722B, and the first circulation flow path 721. In this way, the ink 68 is circulated in the main tank 65, the first supply flow path 711, the second supply flow path 712B, the head portion 67, the second circulation flow path 722B, and the first circulation flow path 721.

Although not shown in the drawings, a case will be explained in which the head-pouch circulation is performed. In the second embodiment, there is a case in which first head-pouch circulation is performed, via the sub pouch 8, the second supply flow path 712A, the head portion 67, and the second circulation flow path 722A, and a case in which second head-pouch circulation is performed, via the sub pouch 8, the second supply flow path 712B, the head portion 67, and the second circulation flow path 722B.

Although not shown in the drawings, when the first head-pouch circulation is performed, the CPU 70 opens the electromagnetic valves 762, 763A, 765, and 766A, and closes the electromagnetic valves 761, 763B, 764, and 766B. A pump (not shown in the drawings) is provided in the second supply flow path 712A or the second circulation flow path 722A. The pump operates in accordance with the control of the CPU 70. In this way, the ink 68 is circulated in the sub pouch 8, the second supply flow path 712A, the head portion 67, and the second circulation flow path 722A.

Although not shown in the drawings, when the second head-pouch circulation is performed, the CPU 70 opens the electromagnetic valves 762, 763B, 765, and 766B, and closes the electromagnetic valves 761, 763A, 764, and 766A. A pump (not shown in the drawings) is provided in the second supply flow path 712B or the second circulation flow path 722B. The pump operates in accordance with the control of the CPU 70. In this way, the ink 68 is circulated in the sub pouch 8, the second supply flow path 712B, the head portion 67, and the second circulation flow path 722B.

The ink 68 flows as described above in the printer 1B. In the second embodiment, the second supply flow path 712 and the first supply flow path 711 merge at the first connection portion 791. The second circulation flow path 722 and the first circulation flow path 721 merge at the second connection portion 792. By the flow paths being connected in this manner, the ink 68 can be circulated in all the flow paths, namely the first supply flow path 711, the second supply flow paths 712A and 712B, the first circulation flow path 721, and the second circulation flow paths 722A and 722B. As a result, similarly to the first embodiment, the possibility of a deterioration in the print quality can be reduced.

The electromagnetic valve 763A that opens and closes the second supply flow path 712A is provided in the second supply flow path 712A. The electromagnetic valve 763B that opens and closes the second supply flow path 712B is provided in the second supply flow path 712B. The electromagnetic valve 766A that opens and closes the second circulation flow path 722A is provided in the second circulation flow path 722A. The electromagnetic valve 766B that opens and closes the second circulation flow path 722B is provided in the second circulation flow path 722B. When the circulation of the ink 68 is performed in at least one of the main tank 65 and the sub pouch 8, namely, when the pouch-tank circulation is performed in the second embodiment, the electromagnetic valves 763A, 763B, 766A, and 766B close the second supply flow paths 712A and 712B, and the second circulation flow paths 722A and 722B (refer to FIG. 10). Thus, when the pouch-tank circulation is performed, the print quality is improved, in the same manner as in the first embodiment.

Next, a printer 1C that is the printer 1 according to a third embodiment will be explained, with reference to FIG. 12 to FIG. 14. In the third embodiment, the same reference numerals are assigned to a configuration that is the same as that of the above-described embodiments, and a detailed explanation of the same configuration is omitted.

Figure 12:
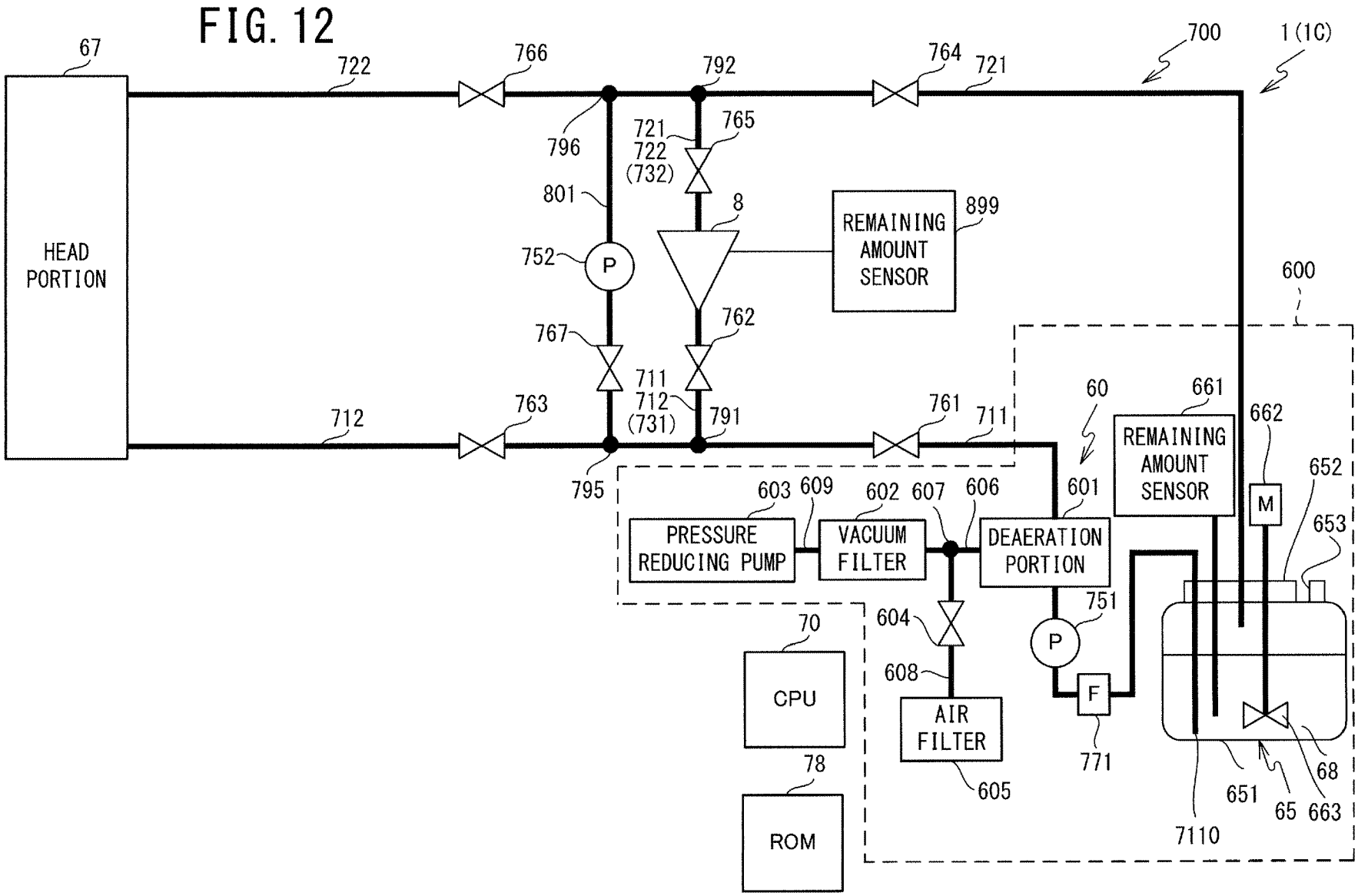
FIG. 12 is a diagram showing flow paths of the ink in the printer.

As shown in FIG. 12, the printer 1C is provided with a bypass flow path 801, a pump 752, and an electromagnetic valve 767, in addition to the configuration of the printer 1A according to the first embodiment. The bypass flow path 801 links the second supply flow path 712 and the second circulation flow path 722. The bypass flow path 801 and the second supply flow path 712 are connected at a fifth connection portion 795. The fifth connection portion 795 is provided between the first connection portion 791 and the electromagnetic valve 763. The bypass flow path 801 and the second circulation flow path 722 are connected at a sixth connection portion 796. The sixth connection portion 796 is provided between the second connection portion 792 and the electromagnetic valve 766.

The pump 752 is provided in the bypass flow path 801. The pump 752 operates in accordance with the control of the CPU 70 and causes the ink 68 to flow from the sixth connection portion 796 to the fifth connection portion 795 side. The electromagnetic valve 767 is provided in the bypass flow path 801, between the pump 752 and the fifth connection portion 795. The electromagnetic valve 767 opens and closes the bypass flow path 801 in accordance with the control of the CPU 70.

Figure 13:
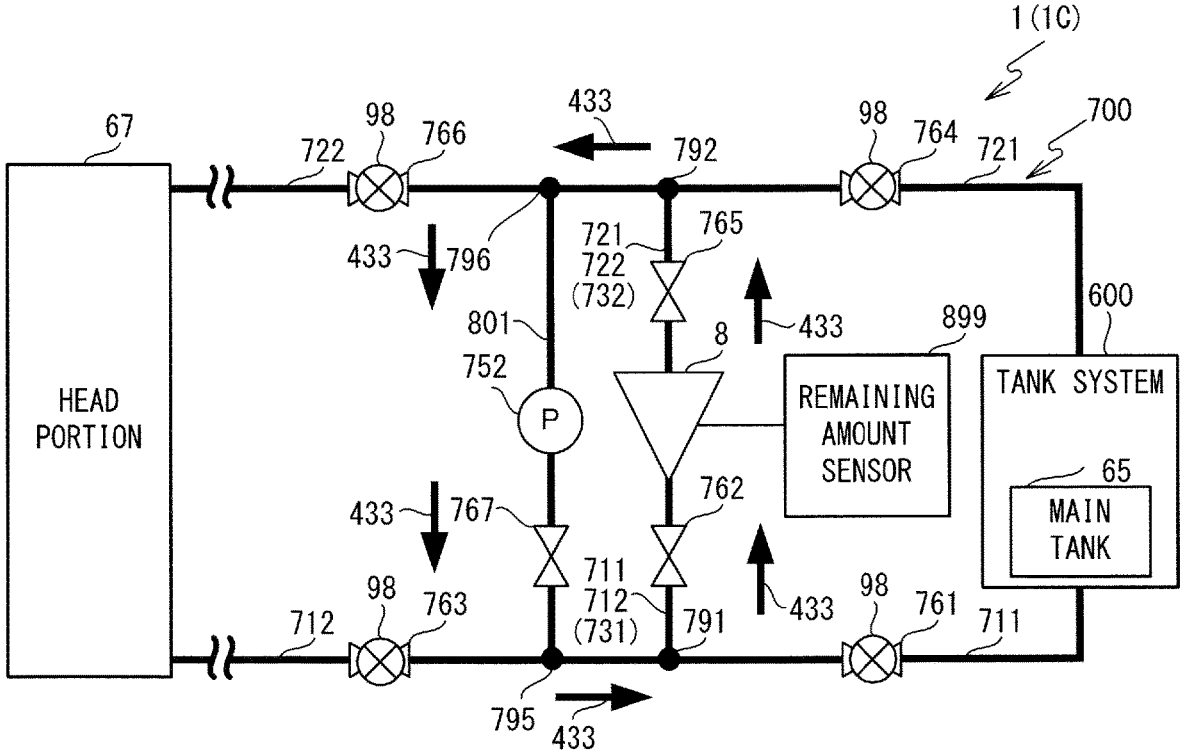
FIG. 13 is a diagram showing a state in which pouch-bypass circulation is performed in the printer.
Figure 14:
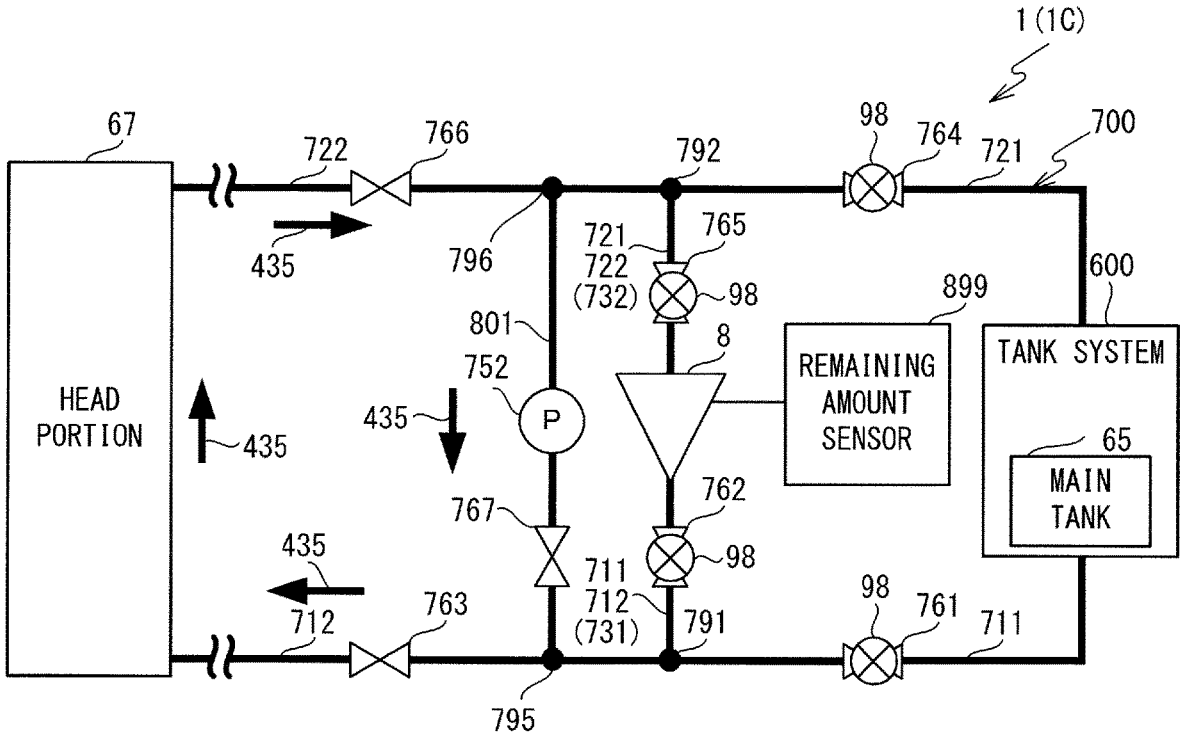
FIG. 14 is a diagram showing a state in which head-bypass circulation is performed in the printer.

In FIG. 13 and FIG. 14, some of the flow paths and the configuration of the tank system 600 are illustrated in a simplified manner, but the configuration of the some of the flow paths and the tank system 600 is the same as in the case shown in FIG. 12. The CPU 70 and the ROM 78 are not illustrated in FIG. 13 and FIG. 14.

Although not shown in the drawings, the flow of the ink 68 in the printer 1C will be explained. A case will be explained in which the sub pouch filling is performed. When the sub pouch filling is performed, the CPU 70 opens the electromagnetic valves 761 and 762, and closes the electromagnetic valves 763, 764, 765, 766 and 767. The pump 751 operates in accordance with the control of the CPU 70. In this way, similarly to the arrows 401 shown in FIG. 3, the ink 68 stored in the main tank 65 is supplied to the sub pouch 8 via the first supply flow path 711. The supplied ink 68 is stored in the sub pouch 8.

Although not shown in the drawings, a case will be explained in which the print operation is performed. When the print operation is performed, the CPU 70 opens the electromagnetic valves 762, 763, 765, and 766, and closes the electromagnetic valves 761, 764, and 767. In accordance with the control of the CPU 70, the operation to eject the ink 68 from the head portion 67 is performed. Similarly to the arrows 402 shown in FIG. 4, by the ink 68 being ejected from the head portion 67, the ink 68 stored in the sub pouch 8 is supplied to the head portion 67, via the second supply flow path 712 and the second circulation flow path 722.

A case will be explained in which the ink 68 is circulated via the sub pouch 8 and the bypass flow path 801, with reference to FIG. 13. In the following explanation, the circulation of the ink 68 via the sub pouch 8 and the bypass flow path 801 is referred to as "pouch-bypass circulation." When the pouch-bypass circulation is performed, the CPU 70 opens the electromagnetic valves 762, 765, and 767, and closes the electromagnetic valves 761, 763, 764, and 766. The pump 752 operates in accordance with the control of the CPU 70. In this way, the ink 68 is circulated in the sub pouch 8, a part of the second supply flow path 712, a part of the second circulation flow path 722, and the bypass flow path 801 (refer to arrows 433). In the pouch-bypass circulation, the ink 68 is not supplied to the head portion 67, and the ink 68 is not circulated from the head portion 67. Similarly, in the pouch-bypass circulation, the ink 68 is not supplied from the main tank 65, and the ink 68 is not circulated to the main tank 65.

Although not shown in the drawings, a case will be explained in which the pouch-tank circulation is performed. When the pouch-tank circulation is performed, the CPU 70 opens the electromagnetic valves 761, 762, 764, and 765, and closes the electromagnetic valves 763, 766, and 767. The pump 751 operates in accordance with the control of the CPU 70. In this way, similarly to the case of the arrows 403 shown in FIG. 5, the ink 68 is sucked up from the main tank 65 and then flows to the main tank 65, via the first supply flow path 711, the sub pouch 8, and the first circulation flow path 721. In this way, the ink 68 is circulated in the main tank 65, the first supply flow path 711, the sub pouch 8, and the first circulation flow path 721.

A case will be explained in which the ink 68 is circulated via the head portion 67 and the bypass flow path 801, with reference to FIG. 14. In the following explanation, the circulation of the ink 68 via the head portion 67 and the bypass flow path 801 is referred to as "head-bypass circulation." In the head-bypass circulation, the CPU 70 opens the electromagnetic valves 763, 766, and 767, and closes the electromagnetic valves 761, 762, 764, and 765. The pump 752 operates in accordance with the control of the CPU 70. In this way, the ink 68 is circulated in the bypass flow path 801, the second supply flow path 712, the head portion 67, and the second circulation flow path 722 (refer to arrows 435). In the head-bypass circulation, the ink 68 is not supplied from the main tank 65, and the ink 68 is not circulated to the main tank 65.

Although not shown in the drawings, a case will be explained in which the head-tank circulation is performed. When the head-tank circulation is performed, the CPU 70 opens the electromagnetic valves 761, 763, 764, and 766, and closes the electromagnetic valves 762, 765, and 767. The pump 751 operates in accordance with the control of the CPU 70. In this way, similarly to the arrows 404 shown in FIG. 6, the ink 68 is sucked up from the main tank 65 and then flows to the main tank 65, via the first supply flow path 711, the second supply flow path 712, the head portion 67, the second circulation flow path 722, and the first circulation flow path 721. In this way, the ink 68 is circulated in the main tank 65, the first supply flow path 711, the second supply flow path 712, the head portion 67, the second circulation flow path 722, and the first circulation flow path 721.

Although not shown in the drawings, a case will be explained in which the head-pouch circulation is performed. When the head-pouch circulation is performed, the CPU 70 opens the electromagnetic valves 762, 763, 765, and 766, and closes the electromagnetic valves 761, 764, and 767. The pump (not shown in the drawings) is provided in the second supply flow path 712 or the second circulation flow path 722. The pump operates in accordance with the control of the CPU 70. In this way, the ink 68 is circulated in the sub pouch 8, the second supply flow path 712, the head portion 67, and the second circulation flow path 722.

The flow rate of the ink 68 will be explained. In the third embodiment, when the head-bypass circulation (refer to FIG. 14), the head-tank circulation, and the head-pouch circulation are performed, which are performed via the head portion 67, "weak circulation" is performed, in which the flow rate of the ink 68 is slower than when the pouch-bypass circulation (refer to FIG. 13) and the pouch-tank circulation are performed. When the pouch-bypass circulation (refer to FIG. 13) and the pouch-tank circulation are performed, "strong circulation" is performed, in which the flow of the ink 68 is faster than when the head-bypass circulation (refer to FIG. 14), the head-tank circulation, and the head-pouch circulation are performed.

When the circulation via the head portion 67 is performed, the weak circulation is performed, and thus, the pressure caused by the circulation can be reduced. As a result, in comparison to a case in which the pressure caused by the circulation is large, the possibility of damaging the meniscus of the ink 68 in the head portion 67 can be reduced. When the pouch-bypass circulation (refer to FIG. 13) and the pouch-tank circulation are performed, the strong circulation is performed, and the pressure of the circulation increases. As a result, in comparison to a case in which the pressure caused by the circulation is small, a greater amount of the ink 68 can be circulated per unit time. Thus, the possibility can be reduced of the sedimentation of the components of the ink 68 in the sub pouch 8 and the main tank 65. Although not particularly explained below, when the weak circulation and the strong circulation are performed, the same effects as those described above are achieved.

When the sub pouch filling is performed, the flow rate of the ink 68 is slower than when the pouch-bypass circulation (refer to FIG. 13) and the pouch-tank circulation are performed. In the sub pouch filling, the flow rate of the ink 68 is slow, and thus, the deaeration efficiency of the deaeration portion 601 improves in comparison to when the flow rate is fast. Therefore, there are fewer air bubbles included in the ink 68 with which the sub pouch 8 is filled, and the print quality thus improves. Although not particularly explained below, the flow rate during the sub pouch filling is slower than when the circulation including the main tank 65 is performed, and the same effects are achieved.

The ink 68 flows as described above in the printer 1C. In the third embodiment, the second supply flow path 712 and the first supply flow path 711 merge at the first connection portion 791. The second circulation flow path 722 and the first circulation flow path 721 merge at the second connection portion 792. By connecting the flow paths in this manner, the printer 1C can circulate the ink 68 in all of the flow paths, namely the first supply flow path 711, the second supply flow path 712, the first circulation flow path 721, and the second circulation flow path 722. As a result, similarly to the first embodiment, the possibility of a deterioration in the print quality can be reduced.

The ink 68 is circulated in the bypass flow path 801 (refer to FIG. 13 and FIG. 14). As a result, the ink 68 can be circulated in all the flow paths, namely the first supply flow path 711, the second supply flow path 712, the first circulation flow path 721, the second circulation flow path 722, and the bypass flow path 801. Thus, in comparison to a case in which the ink 68 is not circulated in some of the flow paths, of the first supply flow path 711, the second supply flow path 712, the first circulation flow path 721, the second circulation flow path 722, and the bypass flow path 801, the possibility can be reduced of a deterioration in the print quality resulting from the sedimentation of the components of the ink 68.

The bypass flow path 801 that links the second supply flow path 712 and the second circulation flow path 722 is provided, and thus, the ink 68 can be circulated via the second supply flow path 712, the bypass flow path 801, and the second circulation flow path 722 (refer to FIG. 13 and FIG. 14). As a result, the ink 68 can be circulated without any impact on the sub pouch 8, and a superfluous amount of the ink 68 can be inhibited from flowing out of the sub pouch 8. Thus, in comparison to a case in which the ink 68 is circulated via the sub pouch 8 and a superfluous amount of the ink 68 flows out of the sub pouch 8, the flow rate of the ink 68 being circulated in the second supply flow path 712 and the second circulation flow path 722 is stable. As a result, the components of the ink 68 do not easily settle in the second supply flow path 712 and the second circulation flow path 722. The possibility can be reduced of a deterioration in the print quality resulting from the sedimentation of the components of the ink 68.

The electromagnetic valve 763 that opens and closes the second supply flow path 712 is provided in the second supply flow path 712. The electromagnetic valve 766 that opens and closes the second circulation flow path 722 is provided in the second circulation flow path 722. When the circulation of the ink 68 is performed in at least one of the main tank 65 and the sub pouch 8, namely, when the pouch-bypass circulation (refer to FIG. 13) and the pouch-tank circulation are performed in the third embodiment, the electromagnetic valves 763 and 766 close the second supply flow path 712 and the second circulation flow path 722. Thus, when the pouch-bypass circulation (refer to FIG. 13) and the pouch-tank circulation are performed, the print quality is improved in a similar manner to that of the first embodiment.

The electromagnetic valve 761 that opens and closes the first supply flow path 711 is provided in the first supply flow path 711. The electromagnetic valve 764 that opens and closes the first circulation flow path 721 is provided in the first circulation flow path 721. When the ink 68 is circulated in the second supply flow path 712 and the second circulation flow path 722, the electromagnetic valves 761 and 764 close the first supply flow path 711 and the first circulation flow path 721 (refer to FIG. 14). Thus, using the electromagnetic valves 761 and 764, in comparison to a case in which the first supply flow path 711 and the first circulation flow path 721 are not closed, it is possible to avoid flow paths of the ink 68 circulation from becoming long in the circulation of the ink 68 including the main tank 65. As a result, the circulation of the ink 68 is performed more efficiently in the second supply flow path 712 and the second circulation flow path 722. The possibility of the sedimentation of the ink 68 can therefore be reduced and the print quality is improved. Note that, as an example of "efficiently," this means that the circulation of the ink 68 can be performed in a shorter time and the like.

Next, a printer 1D that is the printer 1 according to a fourth embodiment will be explained with reference to FIG. 15 to FIG. 17. In the fourth embodiment, the same reference numerals are assigned to a configuration that is the same as that of the above-described embodiments, and a detailed explanation of the same configuration is omitted.

Figure 15:
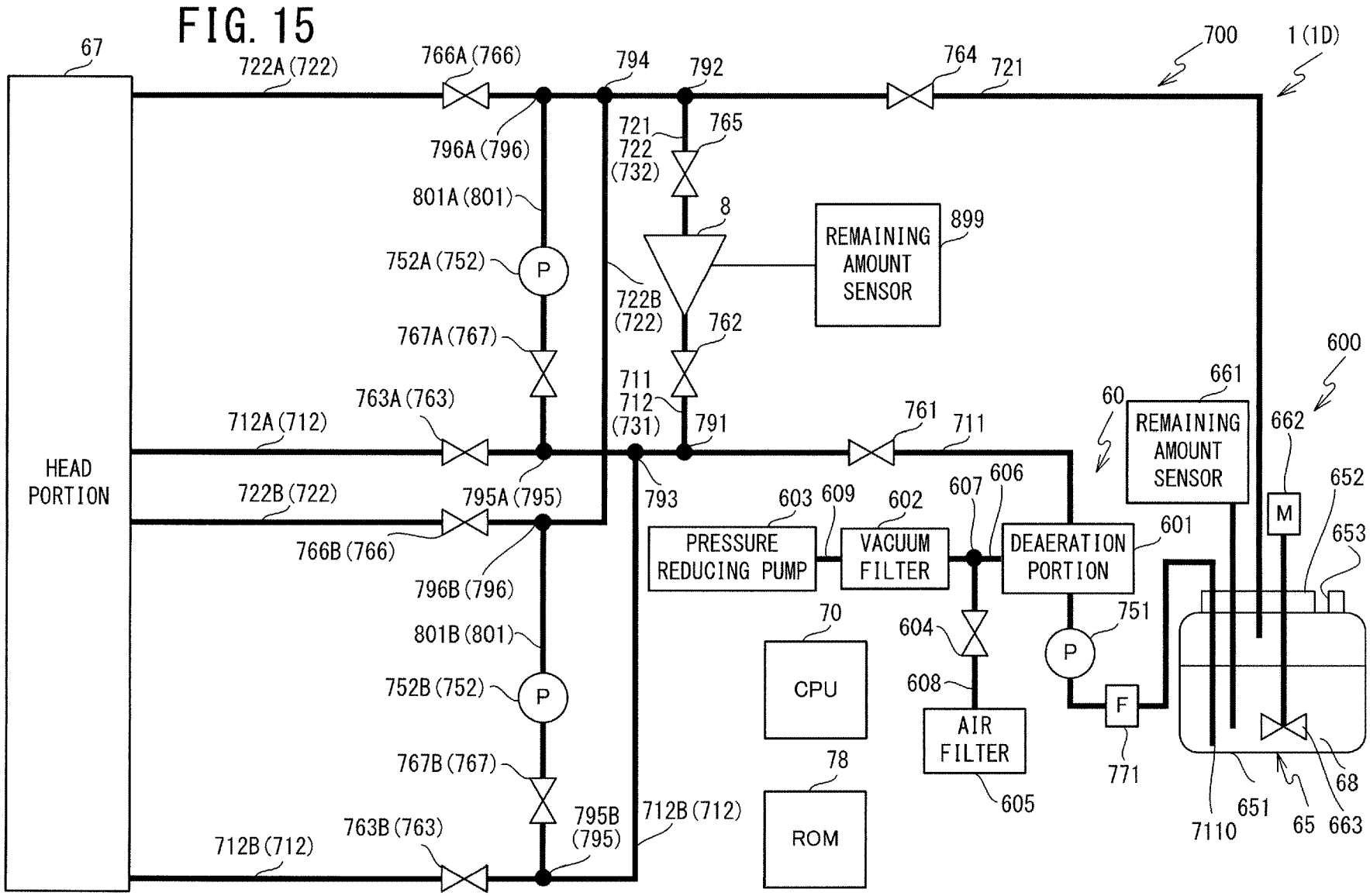
FIG. 15 is a diagram showing flow paths of the ink in the printer.

As shown in FIG. 15, the printer 1D is provided with two of the bypass flow paths 801, two of the pumps 752, two of the electromagnetic valves 767, two of the fifth connection portions 795, and two of the sixth connection portion 796, in addition to the configuration of the printer 1B according to the second embodiment (refer to FIG. 7). In the following explanation, of the two bypass flow paths 801, one is referred to as a bypass flow path 801A and the other is referred to as a bypass flow path 801B. Of the two pumps 752, one is referred to as a pump 752A and the other is referred to as a pump 752B. Of the two electromagnetic valves 767, one is referred to as an electromagnetic valve 767A and the other is referred to as an electromagnetic valve 767B. Of the two fifth connection portions 795, one is referred to as a fifth connection portion 795A and the other is referred to as a fifth connection portion 795B. Of the two sixth connection portions 796, one is referred to as a sixth connection portion 796A and the other is referred to as a sixth connection portion 796B.

The bypass flow path 801A links the second supply flow path 712A and the second circulation flow path 722A. The bypass flow path 801A and the second supply flow path 712A are connected at the fifth connection portion 795A. The fifth connection portion 795A is provided between the third connection portion 793 and the electromagnetic valve 763A. The bypass flow path 801A and the second circulation flow path 722A are connected at the sixth connection portion 796A. The sixth connection portion 796A is provided between the fourth connection portion 794 and the electromagnetic valve 766A.

The bypass flow path 801B links the second supply flow path 712B and the second circulation flow path 722B. The bypass flow path 801B and the second supply flow path 712B are connected at the fifth connection portion 795B. The fifth connection portion 795B is provided between the third connection portion 793 and the electromagnetic valve 763B. The bypass flow path 801B and the second circulation flow path 722B are connected at the sixth connection portion 796B. The sixth connection portion 796B is provided between the fourth connection portion 794 and the electromagnetic valve 766B.

The pump 752A is provided in the bypass flow path 801A. The pump 752A operates in accordance with the control of the CPU 70 and causes the ink 68 to flow from the sixth connection portion 796A toward the fifth connection portion 795A. The electromagnetic valve 767A is provided in the bypass flow path 801A, and is provided between the pump 752A and the fifth connection portion 795A. The electromagnetic valve 767A opens and closes the bypass flow path 801A in accordance with the control of the CPU 70.

The pump 752B is provided in the bypass flow path 801B. The pump 752B operates in accordance with the control of the CPU 70 and causes the ink 68 to flow from the sixth connection portion 796B toward the fifth connection portion 795B. The electromagnetic valve 767B is provided in the bypass flow path 801B, and is provided between the pump 752B and the fifth connection portion 795B. The electromagnetic valve 767B opens and closes the bypass flow path 801B in accordance with the control of the CPU 70.

The flow of the ink 68 in the printer 1D will be explained. A case will be explained in which the sub pouch filling is performed. When the sub pouch filling is performed, the CPU 70 opens the electromagnetic valves 761 and 762, and closes the electromagnetic valves 763A, 763B, 764, 765, 766A, 766B, 767A, and 767B. The pump 751 operates in accordance with the control of the CPU 70. In this way, similarly to the arrows 411 shown in FIG. 8, the ink 68 stored in the main tank 65 is supplied to the sub pouch 8 via the first supply flow path 711. The supplied ink 68 is stored in the sub pouch 8.

A case will be explained in which the print operation is performed. When the print operation is performed, the CPU 70 opens the electromagnetic valves 762, 763A, 763B, 765, 766A, and 766B, and closes the electromagnetic valves 761, 764, 767A, and 767B. In accordance with the control of the CPU 70, the operation is performed to eject the ink 68 from the head portion 67. Similarly to the arrows 412 shown in FIG. 9, by the ink 68 being ejected from the head portion 67, the ink 68 stored in the sub pouch 8 is supplied to the head portion 67, via the second supply flow paths 712A and 712B, and the second circulation flow paths 722A and 722B.

A case will be explained in which the pouch-bypass circulation is performed. In the fourth embodiment, there is a case in which first pouch-bypass circulation is performed, via the sub pouch 8 and the bypass flow path 801A (refer to FIG. 16), and a case in which second pouch-bypass circulation is performed, via the sub pouch 8 and the bypass flow path 801B.

Figure 16:
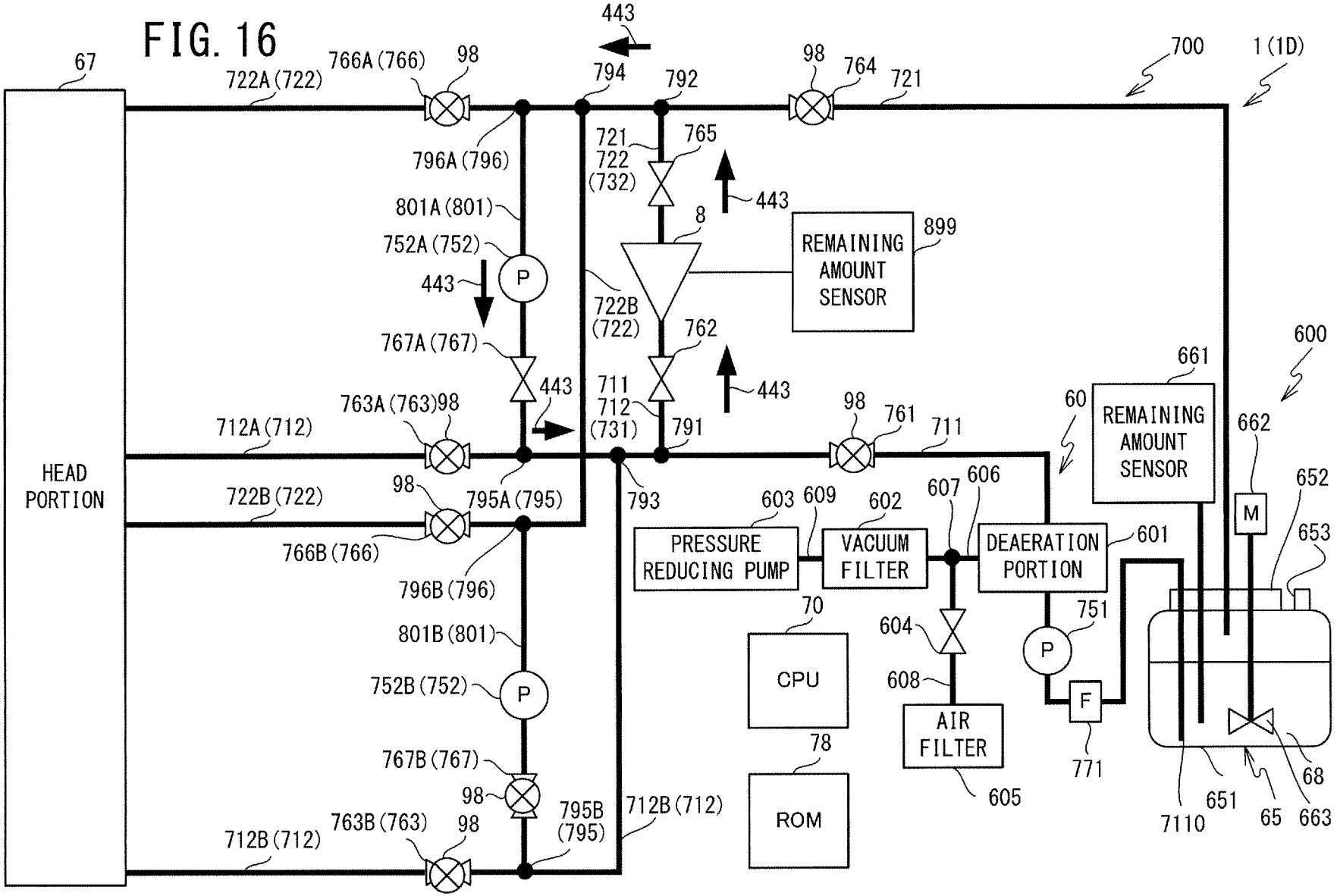
FIG. 16 is a diagram showing a state in which first pouch-bypass circulation is performed in the printer.

As shown in FIG. 16, when the first pouch-bypass circulation is performed, the CPU 70 opens the electromagnetic valves 762, 765, and 767A, and closes the electromagnetic valves 761, 763A, 763B, 764, 766A, 766B, and 767B. The pump 752A operates in accordance with the control of the CPU 70. In this way, the ink 68 is circulated in the sub pouch 8, a part of the second supply flow path 712, a part of the second circulation flow path 722, and the bypass flow path 801A (refer to arrows 443).

Although not shown in the drawings, when the second pouch-bypass circulation is performed, the CPU 70 opens the electromagnetic valves 762, 765, and 767B, and closes the electromagnetic valves 761, 763A, 763B, 764, 766A, 766B and 767A. The pump 752B operates in accordance with the control of the CPU 70. In this way, the ink 68 is circulated in the sub pouch 8, a part of the second supply flow path 712, a part of the second circulation flow path 722, and the bypass flow path 801B.

A case will be explained in which the pouch-tank circulation is performed. When the pouch-tank circulation is performed, the CPU 70 opens the electromagnetic valves 761, 762, 764, and 765, and close the electromagnetic valves 763A, 763B, 766A, 766B, 767A, and 767B. The pump 751 operates in accordance with the control of the CPU 70. In this way, similarly to the arrows 413 shown in FIG. 10, the ink 68 is sucked up from the main tank 65, and then flows to the main tank 65 via the first supply flow path 711, the sub pouch 8, and the first circulation flow path 721. As a result, the ink 68 is circulated in the main tank 65, the first supply flow path 711, the sub pouch 8, and the first circulation flow path 721.

A case will be explained in which the head-bypass circulation is performed. In the fourth embodiment, there is a case in which first head-bypass circulation is performed, via the second supply flow path 712A, the head portion 67, the second circulation flow path 722A, and the bypass flow path 801A (refer to FIG. 17), and a case in which second head-bypass circulation is performed, via the second supply flow path 712B, the head portion 67, the second circulation flow path 722B, and the bypass flow path 801B.

Figure 17:
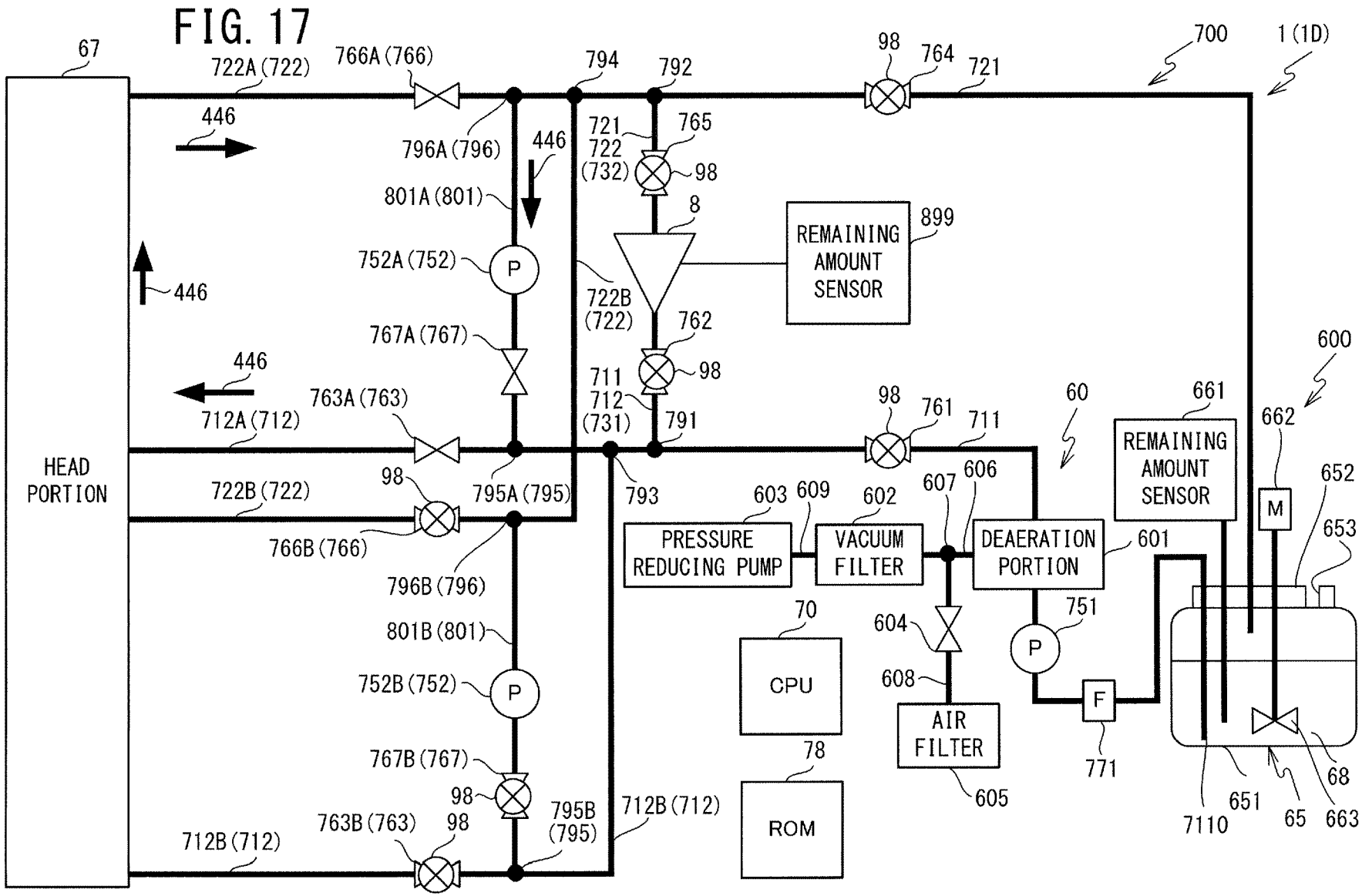
FIG. 17 is a first diagram showing a state in which first head-bypass circulation is performed in the printer.

As shown in FIG. 17, when the first head-bypass circulation is performed, the CPU 70 opens the electromagnetic valves 763A, 766A, and 767A, and closes the electromagnetic valves 761, 762, 764, 765, 763B, 766B, and 767B. The pump 752A operates in accordance with the control of the CPU 70. In this way, the ink 68 is circulated in the bypass flow path 801A, the second supply flow path 712A, the head portion 67, and the second circulation flow path 722A (refer to arrows 446).

Although not shown in the drawings, when the second head-bypass circulation is performed, the CPU 70 opens the electromagnetic valves 763B, 766B, and 767B, and closes the electromagnetic valves 761, 762, 764, 765, 763A, 766A, and 767A. The pump 752B operates in accordance with the control of the CPU 70. In this way, the ink 68 is circulated in the bypass flow path 801B, the second supply flow path 712B, the head portion 67, and the second circulation flow path 722B.

A case will be explained in which the head-tank circulation is performed. In the fourth embodiment, there is a case in which first head-tank circulation is performed, via the main tank 65, the first supply flow path 711, the second supply flow path 712A, the head portion 67, the second circulation flow path 722A, and the first circulation flow path 721, and a case in which second head-tank circulation is performed, via the main tank 65, the first supply flow path 711, the second supply flow path 712B, the head portion 67, the second circulation flow path 722B, and the first circulation flow path 721.

Although not shown in the drawings, when the first head-tank circulation is performed, the CPU 70 opens the electromagnetic valves 761, 763A, 764, and 766A, and closes the electromagnetic valves 762, 763B, 765, 766B, 767A, and 767B. The pump 751 operates in accordance with the control of the CPU 70. In this way, similarly to the arrows 414 shown in FIG. 11, the ink 68 is sucked up from the main tank 65, and then flows to the main tank 65 via the first supply flow path 711, the second supply flow path 712A, the head portion 67, the second circulation flow path 722A, and the first circulation flow path 721. As a result, the ink 68 is circulated in the main tank 65, the first supply flow path 711, the second supply flow path 712A, the head portion 67, the second circulation flow path 722A, and the first circulation flow path 721.

Although not shown in the drawings, when the second head-tank circulation is performed, the CPU 70 opens the electromagnetic valves 761, 763B, 764, and 766B, and closes the electromagnetic valves 762, 763A, 765, 766A, 767A, and 767B. The pump 751 operates in accordance with the control of the CPU 70. In this way, the ink 68 is sucked up from the main tank 65, then flows to the main tank 65 via the first supply flow path 711, the second supply flow path 712B, the head portion 67, the second circulation flow path 722B, and the first circulation flow path 721. As a result, the ink 68 is circulated in the main tank 65, the first supply flow path 711, the second supply flow path 712B, the head portion 67, the second circulation flow path 722B, and the first circulation flow path 721.

A case will be explained in which the head-pouch circulation is performed. In the fourth embodiment, there is a case in which first head-pouch circulation is performed, via the sub pouch 8, the second supply flow path 712A, the head portion 67, and the second circulation flow path 722A, and a case in which second head-pouch circulation is performed, via the sub pouch 8, the second supply flow path 712B, the head portion 67, and the second circulation flow path 722B.

Although not shown in the drawings, when the first head-pouch circulation is performed, the CPU 70 opens the electromagnetic valves 762, 763A, 765, and 766A, and closes the electromagnetic valves 761, 763B, 764, 766B, 767A, and 767B. The pump (not shown in the drawings) is provided in the second supply flow path 712A or the second circulation flow path 722A. The pump operates in accordance with the control of the CPU 70. In this way, the ink 68 is circulated in the sub pouch 8, the second supply flow path 712A, the head portion 67, and the second circulation flow path 722A.

Although not shown in the drawings, when the second head-pouch circulation is performed, the CPU 70 opens the electromagnetic valves 762, 763B, 765, and 766B, and closes the electromagnetic valves 761, 763A, 764, 766A, 767A, and 767B. The pump (not shown in the drawings) is provided in the second supply flow path 712B or the second circulation flow path 722B. The pump operates in accordance with the control of the CPU 70. In this way, the ink 68 is circulated in the sub pouch 8, the second supply flow path 712B, the head portion 67, and the second circulation flow path 722B.

In the fourth embodiment, when the head-bypass circulation (refer to FIG. 17), the head-tank circulation, and the head-pouch circulation are performed, the "weak circulation" is performed in which the flow rate of the ink 68 is slower than when the pouch-bypass circulation (refer to FIG. 16) and the pouch-tank circulation are performed. When the pouch-bypass circulation (refer to FIG. 16) and the pouch-tank circulation are performed, the "strong circulation" is performed in which the flow rate of the ink 68 is faster than when the head-bypass circulation (refer to FIG. 17), the head-tank circulation, and the head-pouch circulation are performed.

The ink 68 flows as described above in the printer 1D. In the fourth embodiment, the second supply flow path 712 and the first supply flow path 711 merge at the first connection portion 791. The second circulation flow path 722 and the first circulation flow path 721 merge at the second connection portion 792. By the flow paths being connected in this manner, the printer 1D can circulate the ink 68 in all of the flow paths, namely the first supply flow path 711, the second supply flow paths 712A and 712B, the first circulation flow path 721, and the second circulation flow paths 722A and 722B. As a result, similarly to the first embodiment, the possibility of a deterioration in the print quality can be reduced.

The ink 68 is also circulated in the bypass flow paths 801A and 801B (refer to FIG. 16 and FIG. 17). Thus, the ink 68 can be circulated in all the flow paths, namely the first supply flow path 711, the second supply flow paths 712A and 712B, the first circulation flow path 721, the second circulation flow paths 722A and 722B, and the bypass flow paths 801A and 801B. As a result, similarly to the third embodiment, the possibility of a deterioration in the print quality can be reduced.

The bypass flow path 801A is provided that links the second supply flow path 712A and the second circulation flow path 722A. The bypass flow path 801B is provided that links the second supply flow path 712B and the second circulation flow path 722B. Thus, the circulation of the ink 68 via the second supply flow path 712A, the bypass flow path 801A, and the second circulation flow path 722A, and the circulation of the ink 68 via the second supply flow path 712B, the bypass flow path 801B, and the second circulation flow path 722B can be performed (refer to FIG. 17). As a result, similarly to the third embodiment, the possibility of a deterioration in the print quality can be reduced.

The electromagnetic valve 763A that opens and closes the second supply flow path 712A is provided in the second supply flow path 712A. The electromagnetic valve 763B that opens and closes the second supply flow path 712B is provided in the second supply flow path 712B. The electromagnetic valve 766A that opens and closes the second circulation flow path 722A is provided in the second circulation flow path 722A. The electromagnetic valve 766B that opens and closes the second circulation flow path 722B is provided in the second circulation flow path 722B. When the circulation of the ink 68 is performed in at least one of the main tank 65 and the sub pouch 8, namely, when the pouch-bypass circulation (refer to FIG. 16) and the pouch-tank circulation are performed in the fourth embodiment, the electromagnetic valves 763A, 763B, 766A, and 766B close the second supply flow paths 712A and 712B and the second circulation flow paths 722A and 722B. Thus, the print quality is improved in a similar manner to that of the first embodiment.

The electromagnetic valve 761 that opens and closes the first supply flow path 711 is provided in the first supply flow path 711. The electromagnetic valve 764 that opens and closes the first circulation flow path 721 is provided in the first circulation flow path 721. When the circulation of the ink 68 is performed in the second supply flow path 712 and the second circulation flow path 722, the electromagnetic valves 761 and 764 close the first supply flow path 711 and the first circulation flow path 721 (refer to FIG. 17). Thus, the print quality is improved in a similar manner to that of the third embodiment.

Next, a printer 1E that is the printer 1 according to a fifth embodiment will be explained with reference to FIG. 18 to FIG. 20. In the fifth embodiment, the same reference numerals are assigned to a configuration that is the same as that of the above-described embodiments, and a detailed explanation of the same configuration is omitted.

Figure 18:
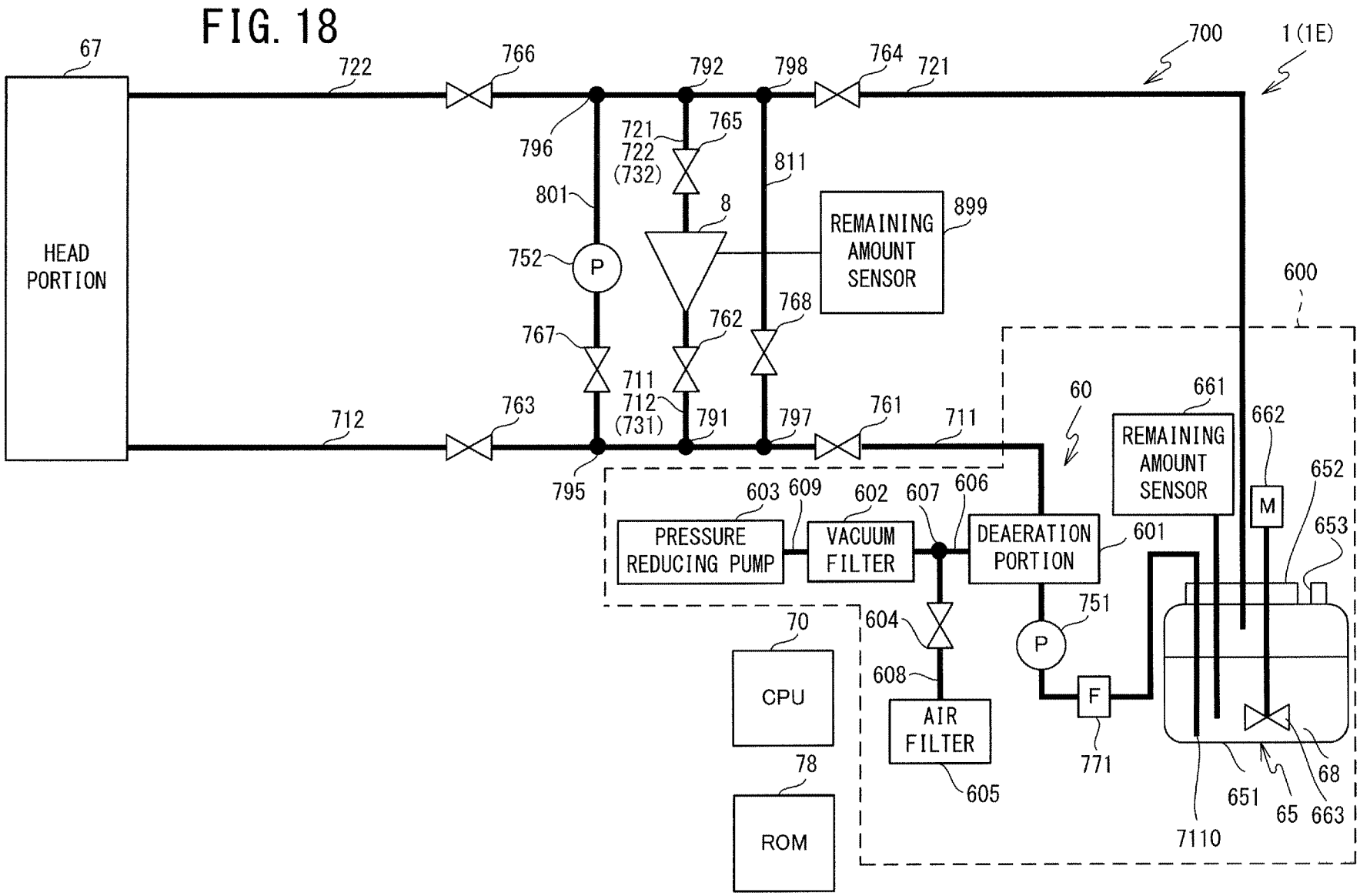
FIG. 18 is a diagram showing flow paths of the ink in the printer.

As shown in FIG. 18, the printer 1E is provided with a bypass flow path 811 and an electromagnetic valve 768, in addition to the configuration of the printer 1C according to the third embodiment. (refer to FIG. 12). The bypass flow path 811 links the first supply flow path 711 and the first circulation flow path 721. The bypass flow path 811 and the first supply flow path 711 are connected at a seventh connection portion 797. The seventh connection portion 797 is provided between the first connection portion 791 and the electromagnetic valve 761. The bypass flow path 811 and the first circulation flow path 721 are connected at an eighth connection portion 798. The eighth connection portion 798 is provided between the second connection portion 792 and the electromagnetic valve 764.

Figure 19:
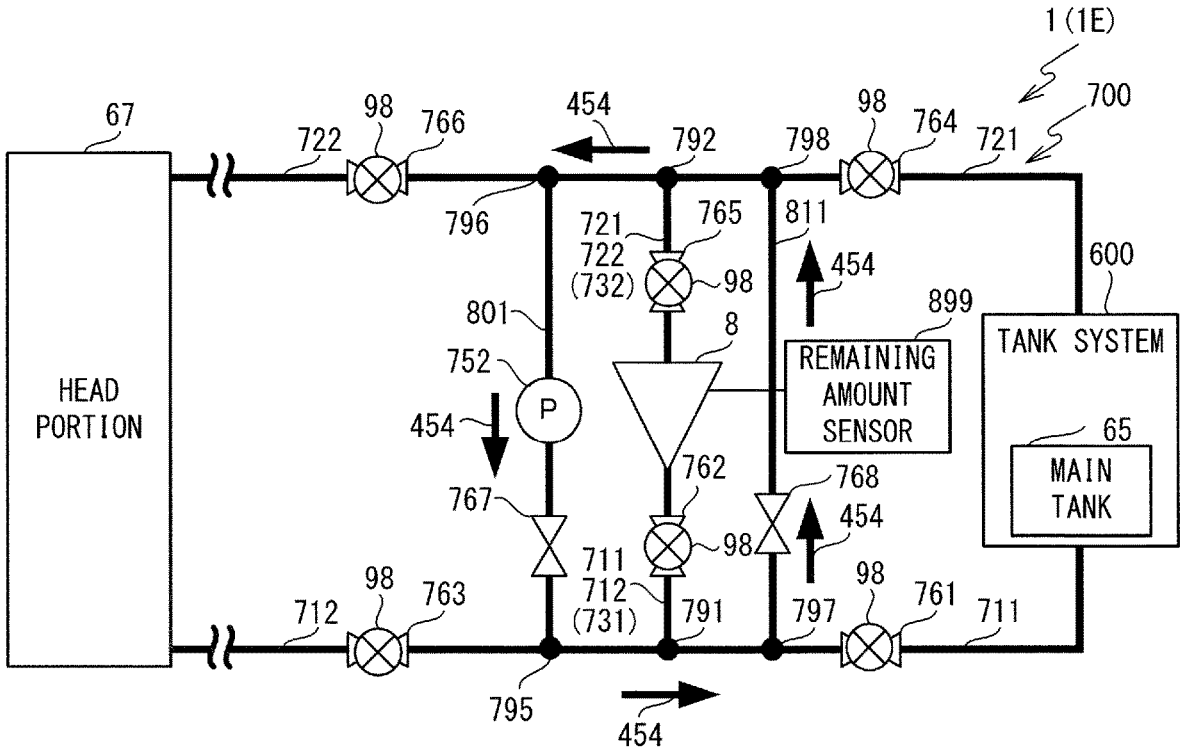
FIG. 19 is a diagram showing a state in which tube circulation is performed in the printer.
Figure 20:
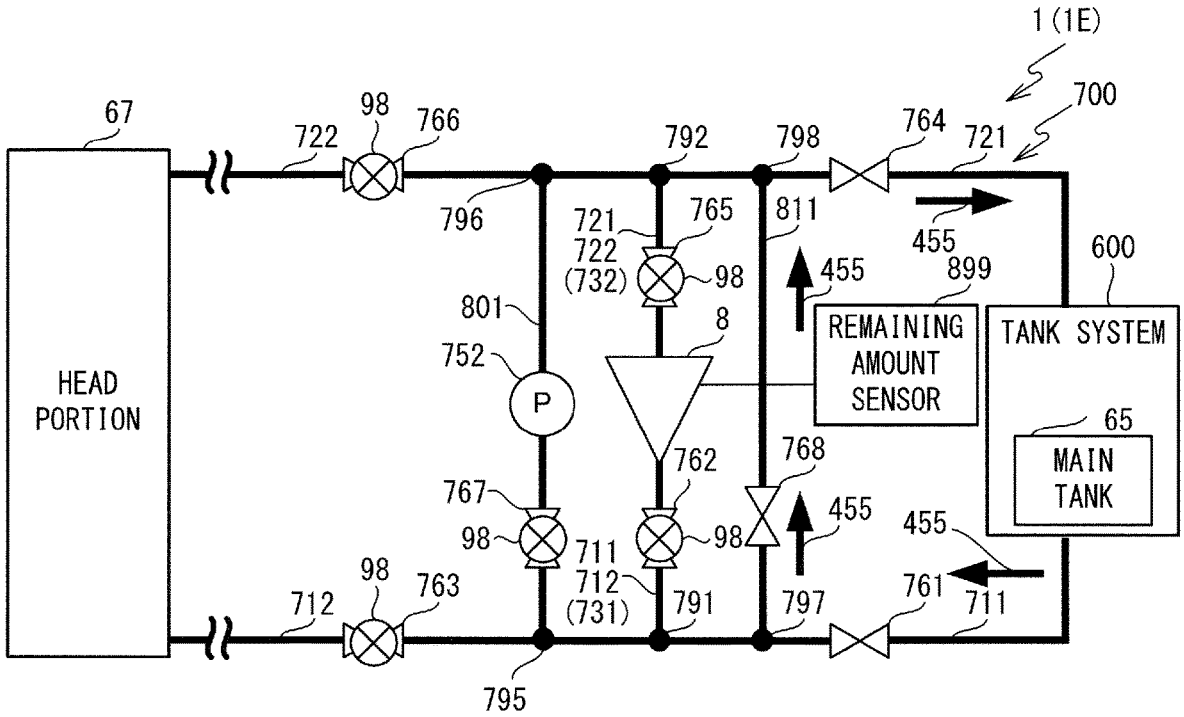
FIG. 20 is a diagram showing a state in which tank-bypass circulation is performed in the printer.

In FIG. 19 and FIG. 20, some of the flow paths and the configuration of the tank system 600 are illustrated in a simplified manner, but the configuration of the some of the flow paths and the tank system 600 is the same as in the case shown in FIG. 18. The CPU 70 and the ROM78 are not illustrated in FIG. 19 and FIG. 20.

The flow of the ink 68 in the printer 1E will be explained. A case will be explained in which the sub pouch filling is performed. When the sub pouch filling is performed, the CPU 70 opens the electromagnetic valves 761 and 762, and closes the electromagnetic valves 763, 764, 765, 766, 767, and 768. The pump 751 operates in accordance with the control of the CPU 70. In this way, similarly to the arrows 401 shown in FIG. 3, the ink 68 stored in the main tank 65 is supplied to the sub pouch 8 via the first supply flow path 711. The supplied ink 68 is stored in the sub pouch 8.

Although not shown in the drawings, a case will be explained in which the print operation is performed. When the print operation is performed, the CPU 70 opens the electromagnetic valves 762, 763, 765, and 766, and closes the electromagnetic valves 761, 764, 767, and 768. In accordance with the control of the CPU 70, the operation is performed to eject the ink 68 from the head portion 67. Similarly to the arrows 402 shown in FIG. 4, by the ink 68 being ejected from the head portion 67, the ink 68 stored in the sub pouch 8 is supplied to the head portion 67, via the second supply flow path 712 and the second circulation flow path 722.

Although not shown in the drawings, a case will be explained in which the pouch-bypass circulation is performed. When the pouch-bypass circulation is performed, the CPU 70 opens the electromagnetic valves 762, 765, and 767, and closes the electromagnetic valves 761, 763, 764, 766, and 768. The pump 752 operates in accordance with the control of the CPU 70. In this way, similarly to the arrows 433 shown in FIG. 13, the ink 68 is circulated in the sub pouch 8, a part of the second supply flow path 712, a part of the second circulation flow path 722, and the bypass flow path 801.

A case will be explained in which the circulation of the ink 68 is performed via the bypass flow path 801 and the bypass flow path 811 will be explained. In the following explanation, the circulation of the ink 68 via the bypass flow path 801 and the bypass flow path 811 is sometimes referred to as "tube circulation."

As shown in FIG. 19, when the tube circulation is performed, the CPU 70 opens the electromagnetic valves 767 and 768, and closes the electromagnetic valves 761, 762, 763, 764, 765, and 766. The pump 752 operates in accordance with the control of the CPU 70. In this way, the ink 68 is circulated in the bypass flow path 801, a part of the first supply flow path 711, a part of the second supply flow path 712, a part of the first circulation flow path 721, a part of the second circulation flow path 722, and the bypass flow path 811 (refer to arrows 454).

A case will be explained in which the circulation of the ink 68 is performed via the main tank 65 and the bypass flow path 811. In the following explanation, the circulation of the ink 68 via the main tank 65 and the bypass flow path 811 is referred to as "tank-bypass circulation." As shown in FIG. 20, when the tank-bypass circulation is performed, the CPU 70 opens the electromagnetic valves 761, 764, and 768, and closes the electromagnetic valves 762, 763, 765, 766, and 767. The pump 751 operates in accordance with the control of the CPU 70. In this way, the ink 68 is sucked up from the main tank 65, and then flows to the main tank 65 via the first supply flow path 711, the bypass flow path 811, and the first circulation flow path 721 (refer to arrows 455). As a result, the ink 68 is circulated in the main tank 65, the first supply flow path 711, the bypass flow path 811, and the first circulation flow path 721.

Although not shown in the drawings, a case will be explained in which the head-bypass circulation is performed. When the head-bypass circulation is performed, the CPU 70 opens the electromagnetic valves 763, 766, and 767, and closes the electromagnetic valves 761, 762, 764, 765, and 768. The pump 752 operates in accordance with the control of the CPU 70. In this way, similarly to the arrows 435 shown in FIG. 14, the ink 68 is circulated in the bypass flow path 801, the second supply flow path 712, the head portion 67, and the second circulation flow path 722. In the head-bypass circulation, the ink 68 is not supplied from the main tank 65, and the ink 68 is not circulated to the main tank 65.

Although not shown in the drawings, a case will be explained in which the head-bypass circulation and the pouch-tank circulation are simultaneously performed. In this case, electromagnetic valves (not shown in the drawings) are provided in each of the second supply flow path 712 that connects the first connection portion 791 and the fifth connection portion 795, and the second circulation flow path 722 that connects the second connection portion 792 and the sixth connection portion 796. The CPU 70 closes these electromagnetic valves. Further, the CPU 70 opens the electromagnetic valves 763, 766, 767, 761, 762, 764, and 765, and closes the electromagnetic valve 768. The pumps 751 and 752 operate simultaneously in accordance with the control of the CPU 70. In this way, in the head-bypass circulation and the pouch-tank circulation, the ink 68 can be caused to simultaneously circulate. As a result, the printer 1 can efficiently perform the circulation of the ink 68, in comparison to a case in which the head-bypass circulation and the pouch-tank circulation are each separately performed.

Although not shown in the drawings, a case will be explained in which the head-bypass circulation and the tank-bypass circulation are simultaneously performed. In this case, electromagnetic valves (not shown in the drawings) are provided in each of the second supply flow path 712 that connects the seventh connection portion 797 and the fifth connection portion 795, and the second circulation flow path 722 that connects the sixth connection portion 796 and the eighth connection portion 798. The CPU 70 closes these electromagnetic valves. Further, the CPU 70 opens the electromagnetic valves 763, 766, 767, 761, 764, and 768, and closes the electromagnetic valves 762 and 765. The pumps 751 and 752 operate simultaneously in accordance with the control of the CPU 70. In this way, in the head-bypass circulation and tank-bypass circulation, the ink 68 can be caused to simultaneously circulate. As a result, the printer 1 can efficiently perform the circulation of the ink 68, in comparison to a case in which the head-bypass circulation and the tank-bypass circulation are each separately performed.

Although not shown in the drawings, a case will be explained in which the head-tank circulation is performed. When the head-tank circulation is performed, the CPU 70 opens the electromagnetic valves 761, 763, 764, and 766, and closes the electromagnetic valves 762, 765, 767 and 768. The pump 751 operates in accordance with the control of the CPU 70. In this way, similarly to the arrows 404 shown in FIG. 6, the ink 68 is sucked up from the main tank 65, then flows to the main tank 65 via the first supply flow path 711, the second supply flow path 712, the head portion 67, the second circulation flow path 722, and the first circulation flow path 721. As a result, the ink 68 is circulated in the main tank 65, the first supply flow path 711, the second supply flow path 712, the head portion 67, the second circulation flow path 722, and the first circulation flow path 721.

Although not shown in the drawings, a case will be explained in which the head-pouch circulation is performed. When the head-pouch circulation is performed, the CPU 70 opens the electromagnetic valves 762, 763, 765, and 766, and closes the electromagnetic valves 761, 764, 767, and 768. The pump (not shown in the drawings) is provided in the second supply flow path 712 or the second circulation flow path 722. The pump operates in accordance with the control of the CPU 70. In this way, the ink 68 is circulated in the sub pouch 8, the second supply flow path 712, the head portion 67, and the second circulation flow path 722.

Although not shown in the drawings, a case will be explained in which the pouch-tank circulation is performed. When the pouch-tank circulation is performed, the CPU 70 opens the electromagnetic valves 761, 762, 764, and 765, and closes the electromagnetic valves 763, 766, 767, and 768. The pump 751 operates in accordance with the control of the CPU 70. In this way, similarly to the arrows 403 shown in FIG. 5, the ink 68 is sucked up from the main tank 65, then flows to the main tank 65 via the first supply flow path 711, the sub pouch 8, and the first circulation flow path 721. As a result, the ink 68 is circulated in the main tank 65, the first supply flow path 711, the sub pouch 8, and the first circulation flow path 721.

The flow rate of the ink 68 will be explained. In the fifth embodiment, when the head-bypass circulation, the head-tank circulation, and the head-pouch circulation are performed via the head portion 67, the "weak circulation" is performed in which the flow rate of the ink 68 is slower than when the pouch-bypass circulation, the pouch-tank circulation, and the tank-bypass circulation (refer to FIG. 20) are performed. When the pouch-bypass circulation, the pouch-tank circulation, and the tank-bypass circulation (refer to FIG. 20) are performed, the "strong circulation" is performed in which the flow rate of the ink 68 is faster than when the head-bypass circulation, the head-tank circulation, and the head-pouch circulation are performed.

The ink 68 flows as described above in the printer 1E. In the fifth embodiment, the second supply flow path 712 and the first supply flow path 711 merge at the first connection portion 791. The second circulation flow path 722 and the first circulation flow path 721 merge at the second connection portion 792. By the flow paths being connected in this manner, the printer 1E can circulate the ink 68 in all of the flow paths, namely the first supply flow path 711, the second supply flow path 712, the first circulation flow path 721, and the second circulation flow path 722. As a result, similarly to the first embodiment, the possibility of a deterioration in the print quality can be reduced.

The ink 68 is also circulated in the bypass flow path 801 (refer to FIG. 19). The ink 68 is also circulated in the bypass flow path 811 (refer to FIG. 19 and FIG. 20). Thus, the ink 68 can be circulated in all the flow paths, namely the first supply flow path 711, the second supply flow path 712, the first circulation flow path 721, the second circulation flow path 722, the bypass flow path 801, and the bypass flow path 811. As a result, similarly to the third embodiment, the possibility of a deterioration in the print quality can be reduced.

By providing the bypass flow path 801 that links the second supply flow path 712 and the second circulation flow path 722, the ink 68 can be circulated via the second supply flow path 712, the bypass flow path 801, and the second circulation flow path 722 (refer to FIG. 19). As a result, similarly to the third embodiment, the possibility of a deterioration in the print quality can be reduced.

The electromagnetic valve 763 that opens and closes the second supply flow path 712 is provided in the second supply flow path 712. The electromagnetic valve 766 that opens and closes the second circulation flow path 722 is provided in the second circulation flow path 722. When the circulation of the ink 68 is performed in at least one of the main tank 65 and the sub pouch 8, namely, when the tank-bypass circulation (refer to FIG. 20), the pouch-bypass circulation, and the pouch-tank circulation are performed in the fifth embodiment, the electromagnetic valves 763 and 766 close the second supply flow path 712 and the second circulation flow path 722 (refer to FIG. 20). Thus, the print quality is improved in a similar manner to that of the first embodiment.

The electromagnetic valve 761 that opens and closes the first supply flow path 711 is provided in the first supply flow path 711. The electromagnetic valve 764 that opens and closes the first circulation flow path 721 is provided in the first circulation flow path 721. When the ink 68 is circulated in the second supply flow path 712 and the second circulation flow path 722, the electromagnetic valves 761 and 764 close the first supply flow path 711 and the first circulation flow path 721 (refer to FIG. 19). Thus, the print quality is improved in a similar manner to that of the third embodiment.

A printer 1F that is the printer 1 according to a sixth embodiment will be explained with reference to FIG. 21 to FIG. 23. In the sixth embodiment, the same reference numerals are assigned to a configuration that is the same as that of the above-described embodiments, and a detailed explanation of the same configuration is omitted.

Figure 21:
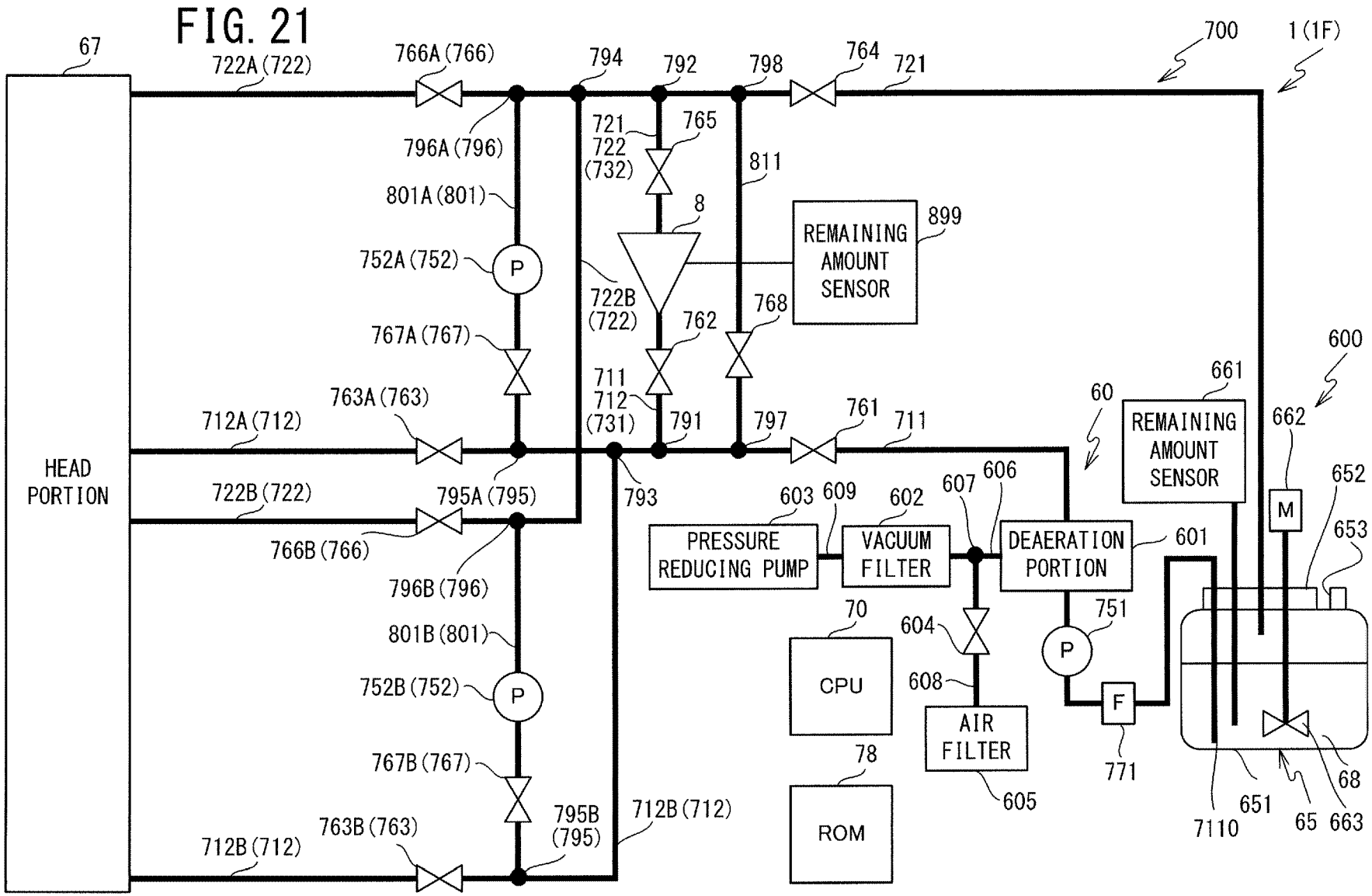
FIG. 21 is a diagram showing flow paths of the ink in the printer.

As shown in FIG. 21, the printer 1F is provided with the bypass flow path 811 and the electromagnetic valve 768, in addition to the configuration of the printer 1D according to the fourth embodiment (refer to FIG. 15). The bypass flow path 811 and the electromagnetic valve 768 are the same as those of the printer 1E according to the fifth embodiment (refer to FIG. 18).

The flow of the ink 68 in the printer 1F will be explained. A case will be explained in which the sub pouch filling is performed. When the sub pouch filling is performed, the CPU 70 opens the electromagnetic valves 761 and 752, and closes the electromagnetic valves 763A, 763B, 764, 765, 766A, 766B, 767A, 767B, and 768. The pump 751 operates in accordance with the control of the CPU 70. In this way, similarly to the arrows 411 shown in FIG. 8, the ink 68 stored in the main tank 65 is supplied to the sub pouch 8 via the first supply flow path 711. The supplied ink 68 is stored in the sub pouch 8.

A case will be explained in which the print operation is performed. When the print operation is performed, the CPU 70 opens the electromagnetic valves 762, 763A, 763B, 765, 766A and 766B, and closes the electromagnetic valves 761, 764, 767A, 767B, and 768. In accordance with the control of the CPU 70, the operation is performed to eject the ink 68 from the head portion 67. Similarly to the arrows 412 shown in FIG. 9, by the ink 68 being ejected from the head portion 67, the ink 68 stored in the sub pouch 8 is supplied to the head portion 67, via the second supply flow paths 712A and 712B, and the second circulation flow paths 722A and 722B.

A case will be explained in which the pouch-bypass circulation is performed. In the sixth embodiment, there is a case in which first pouch-bypass circulation is performed, via the sub pouch 8 and the bypass flow path 801A, and a case in which second pouch-bypass circulation is performed, via the sub pouch 8 and the bypass flow path 801B.

Although not shown in the drawings, when the first pouch-bypass circulation is performed, the CPU 70 opens the electromagnetic valves 762, 765, and 767A, and closes the electromagnetic valves 761, 763A, 763B, 764, 766A, 766B, 767B, and 768. The pump 752A operates in accordance with the control of the CPU 70. In this way, similarly to the arrows 443 shown in FIG. 16, the ink 68 is circulated in the sub pouch 8, a part of the second supply flow path 712, a part of the second circulation flow path 722, and the bypass flow path 801A.

Although not shown in the drawings, when the second pouch-bypass circulation is performed, the CPU 70 opens the electromagnetic valves 762, 765, and 767B, and closes the electromagnetic valves 761, 763A, 763B, 764, 766A, 766B, 767A, and 768. The pump 752B operates in accordance with the control of the CPU 70. In this way, the ink 68 is circulated in the sub pouch 8, a part of the second supply flow path 712, a part of the second circulation flow path 722, and the bypass flow path 801B.

A case will be explained in which the tube circulation is performed. In the sixth embodiment, there is a case in which first tube circulation is performed, via the bypass flow path 801A and the bypass flow path 811 (refer to FIG. 22), and a case in which second tube circulation is performed, via the bypass flow path 801B and the bypass flow path 811.

Figure 22:
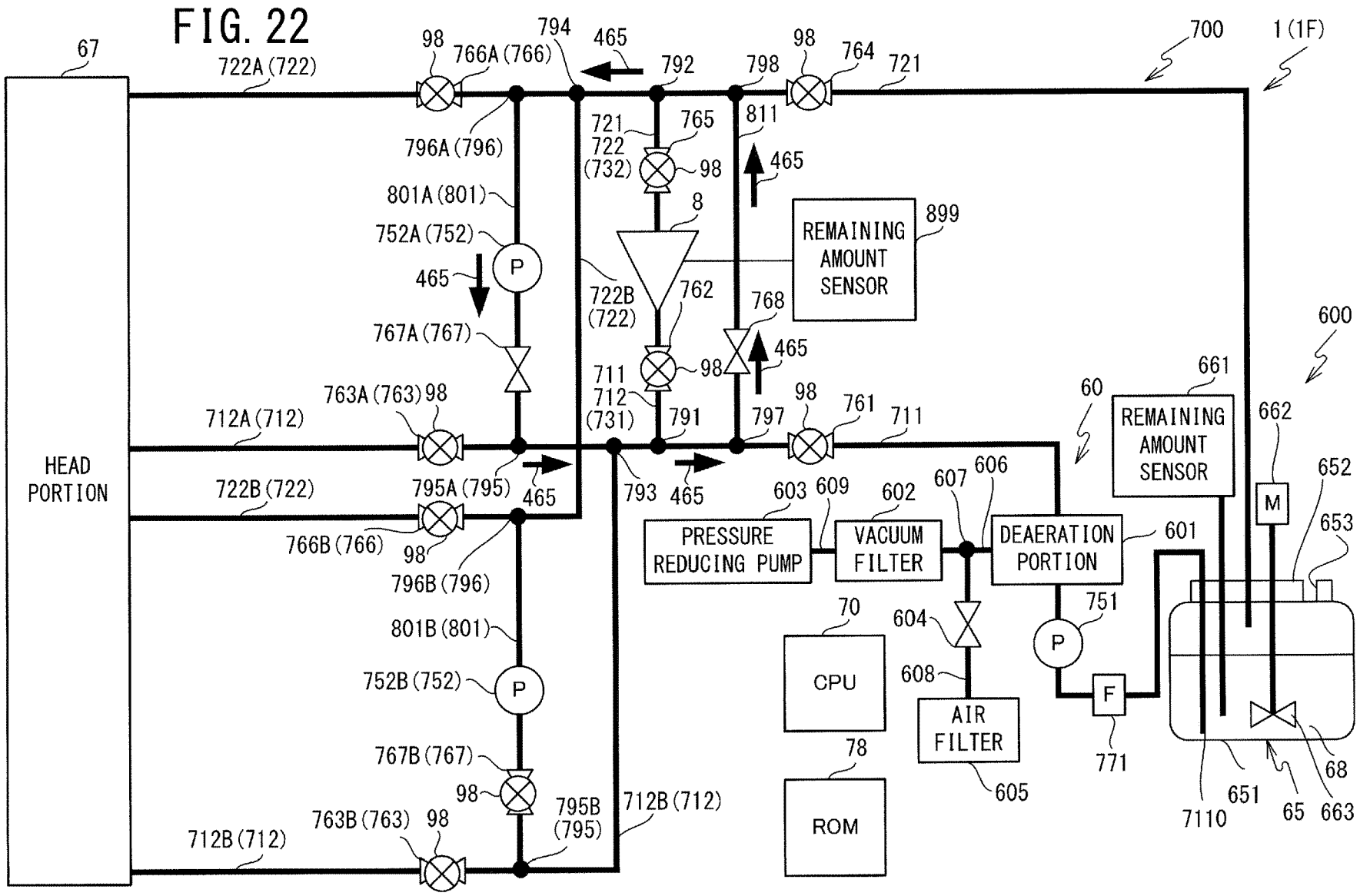
FIG. 22 is a diagram showing a state in which first tube circulation is performed in the printer.
Figure 23:
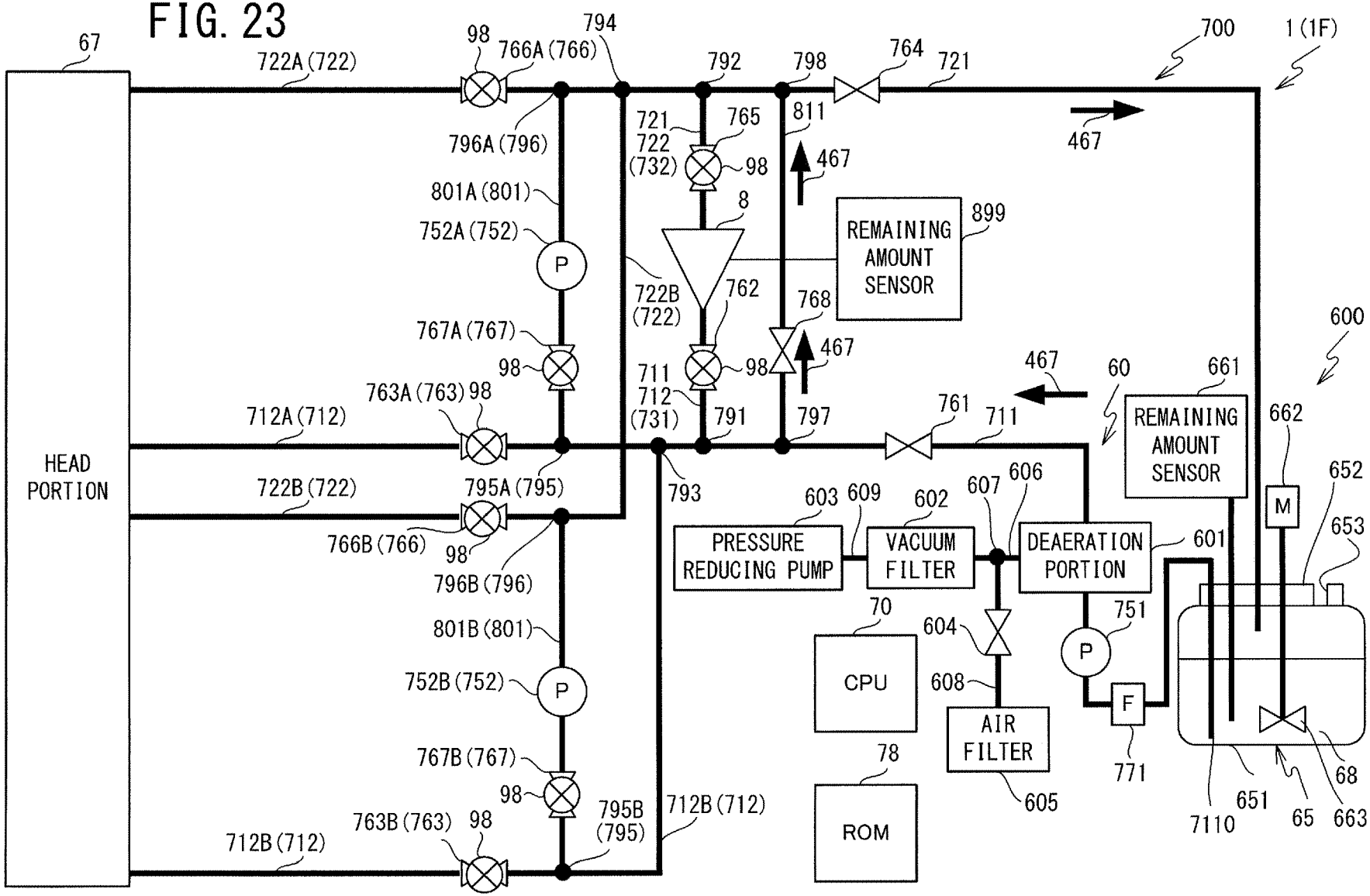
FIG. 23 is a diagram showing a state in which the tank-bypass circulation is performed in the printer.

As shown in FIG. 22, when the first tube circulation is performed, the CPU 70 opens the electromagnetic valves 767A and 768, and closes the electromagnetic valves 761, 762, 763A, 763B, 764, 765, 766A, 766B, and 767B. The pump 752A operates in accordance with the control of the CPU 70. In this way, the ink 68 is circulated in the bypass flow path 801A, a part of the first supply flow path 711, a part of the second supply flow path 712, a part of the first circulation flow path 721, a part of the second circulation flow path 722, and the bypass flow path 811 (refer to arrows 465).

Although not shown in the drawings, when the second tube circulation is performed, the CPU 70 opens the electromagnetic valves 767B and 768, and closes the electromagnetic valves 761, 762, 763A, 763B, 764, 765, 766A, 766B, and 767A. The pump 752B operates in accordance with the control of the CPU 70. In this way, the ink 68 is circulated in the bypass flow path 801B, a part of the first supply flow path 711, a part of the second supply flow path 712, a part of the first circulation flow path 721, a part of the second circulation flow path 722, and the bypass flow path 811.

A case will be explained in which the tank-bypass circulation is performed, with reference to FIG. 23. When the tank-bypass circulation is performed, the CPU 70 opens the electromagnetic valves 761, 764, 768, and closes the electromagnetic valves 762, 763A, 763B, 765, 766A, 766B, 767A, and 767B. The pump 751 operates in accordance with the control of the CPU 70. In this way, the ink 68 is sucked up from the main tank 65, and then flows to the main tank 65 via the first supply flow path 711, the bypass flow path 811, and the first circulation flow path 721 (refer to arrows 467). As a result, the ink 68 is circulated in the main tank 65, the first supply flow path 711, the bypass flow path 811, and the first circulation flow path 721.

A case will be explained in which the head-bypass circulation is performed. In the sixth embodiment, there is a case in which first head-bypass circulation is performed, via the second supply flow path 712A, the head portion 67, the second circulation flow path 722A, and the bypass flow path 801A, and a case in which second head-bypass circulation is performed, via the second supply flow path 712B, the head portion 67, the second circulation flow path 722B, and the bypass flow path 801B.

Although not shown in the drawings, when the first head-bypass circulation is performed, the CPU 70 opens the electromagnetic valves 763A, 766A, and 767A, and closes the electromagnetic valves 761, 762, 763B, 764, 765, 766B, 767B, and 768. The pump 752A operates in accordance with the control of the CPU 70. In this way, similarly to the arrows 446 shown in FIG. 17, the ink 68 is circulated in the bypass flow path 801A, the second supply flow path 712A, the head portion 67, and the second circulation flow path 722A.

Although not shown in the drawings, when the second head-bypass circulation is performed, the CPU 70 opens the electromagnetic valves 763B, 766B, and 767B, and closes the electromagnetic valves 761, 762, 763A, 764, 765, 766A, 767A, and 768. The pump 752B operates in accordance with the control of the CPU 70. In this way, the ink 68 is circulated in the bypass flow path 801B, the second supply flow path 712B, the head portion 67, and the second circulation flow path 722B.

A case will be explained in which the head-tank circulation is performed. In the sixth embodiment, there is a case in which first head-tank circulation is performed, via the main tank 65, the first supply flow path 711, the second supply flow path 712A, the head portion 67, the second circulation flow path 722A, and the first circulation flow path 721, and a case in which second head-tank circulation is performed, via the main tank 65, the first supply flow path 711, the second supply flow path 712B, the head portion 67, the second circulation flow path 722B, and the first circulation flow path 721.

Although not shown in the drawings, when the first head-tank circulation is performed, the CPU 70 opens the electromagnetic valves 761, 763A, 764, and 766A, and closes the electromagnetic valves 762, 763B, 765, 766B, 767A, 767B, and 768. The pump 751 operates in accordance with the control of the CPU 70. In this way, similarly to the arrows 414 shown in FIG. 11, the ink 68 is sucked up from the main tank 65 and then flows to the main tank 65, via the first supply flow path 711, the second supply flow path 712A, the head portion 67, the second circulation flow path 722A, and the first circulation flow path 721. In this way, the ink 68 is circulated in the main tank 65, the first supply flow path 711, the second supply flow path 712A, the head portion 67, the second circulation flow path 722A, and the first circulation flow path 721.

Although not shown in the drawings, when the second head-tank circulation is performed, the CPU 70 opens the electromagnetic valves 761, 763B, 764, and 766B, and closes the electromagnetic valves 762, 763A, 765, 766A, 767A, 767B, and 768. The pump 751 operates in accordance with the control of the CPU 70. In this way, the ink 68 is sucked up from the main tank 65 and then flows to the main tank 65, via the first supply flow path 711, the second supply flow path 712B, the head portion 67, the second circulation flow path 722B, and the first circulation flow path 721. In this way, the ink 68 is circulated in the main tank 65, the first supply flow path 711, the second supply flow path 712B, the head portion 67, the second circulation flow path 722B, and the first circulation flow path 721.

Although not shown in the drawings, a case will be explained in which the head-pouch circulation is performed. In the sixth embodiment, there is a case in which first head-pouch circulation is performed, via the sub pouch 8, the second supply flow path 712A, the head portion 67, and the second circulation flow path 722A, and a case in which second head-pouch circulation is performed, via the sub pouch 8, the second supply flow path 712B, the head portion 67, and the second circulation flow path 722B.

Although not shown in the drawings, when the first head-pouch circulation is performed, the CPU 70 opens the electromagnetic valves 762, 763A, 765, and 766A, and closes the electromagnetic valves 761, 763B, 764, 766B, 767A, 767B, and 768. The pump (not shown in the drawings) is provided in the second supply flow path 712A or the second circulation flow path 722A. The pump operates in accordance with the control of the CPU 70. In this way, the ink 68 is circulated in the sub pouch 8, the second supply flow path 712A, the head portion 67, and the second circulation flow path 722A.

Although not shown in the drawings, when the second head-pouch circulation is performed, the CPU 70 opens the electromagnetic valves 762, 763B, 765, and 766B, and closes the electromagnetic valves 761, 763A, 764, 766A, 767A, 767B, and 768. The pump (not shown in the drawings) is provided in the second supply flow path 712B or the second circulation flow path 722B. The pump operates in accordance with the control of the CPU 70. In this way, the ink 68 is circulated in the sub pouch 8, the second supply flow path 712B, the head portion 67, and the second circulation flow path 722B.

A case will be explained in which the pouch-tank circulation is performed. When the pouch-tank circulation is performed, the CPU 70 opens the electromagnetic valves 761, 762, 764, and 765, and closes the electromagnetic valves 763A, 763B, 766A, 766B, 767A, 767B, and 768. The pump 751 operates in accordance with the control of the CPU 70. In this way, similarly to the arrows 413 shown in FIG. 10, the ink 68 is sucked up from the main tank 65, and then flows to the main tank 65 via the first supply flow path 711, the sub pouch 8, and the first circulation flow path 721. In this way, the ink 68 is circulated in the main tank 65, the first supply flow path 711, the sub pouch 8, and the first circulation flow path 721.

The flow rate of the ink 68 will be explained. In the sixth embodiment, when the head-bypass circulation, the head-tank circulation, and the head-pouch circulation are performed via the head portion 67, the "weak circulation" is performed in which the flow rate of the ink 68 is slower than when the pouch-bypass circulation, the pouch-tank circulation, and the tank-bypass circulation (refer to FIG. 23) are performed. When the pouch-bypass circulation, the pouch-tank circulation, and the tank-bypass circulation (refer to FIG. 23) are performed, the "strong circulation" is performed in which the flow rate of the ink 68 is faster than when the head-bypass circulation, the head-tank circulation, and the head-pouch circulation are performed.

The ink 68 flows as described above in the printer 1F. In the sixth embodiment, the second supply flow path 712 and the first supply flow path 711 merge at the first connection portion 791. The second circulation flow path 722 and the first circulation flow path 721 merge at the second connection portion 792. By the flow paths being connected in this manner, the printer 1F can circulate the ink 68 in all the flow paths, namely the first supply flow path 711, the second supply flow paths 712A and 712B, the first circulation flow path 721, and the second circulation flow paths 722A and 722B. As a result, similarly to the first embodiment, the possibility of a deterioration in the print quality can be reduced.

The ink 68 is circulated in the bypass flow paths 801A and 801B (refer to FIG. 22). The ink 68 is circulated in the bypass flow path 811 (refer to FIG. 22 and FIG. 23). Thus, the ink 68 can be circulated in all the flow paths, namely the first supply flow path 711, the second supply flow paths 712A and 712B, the first circulation flow path 721, the second circulation flow paths 722A and 722B, the bypass flow paths 801A and 801B, and the bypass flow path 811. As a result, similarly to the third embodiment, the possibility of a deterioration in the print quality can be reduced.

The bypass flow path 801A is provided that links the second supply flow path 712A and the second circulation flow path 722A. The bypass flow path 801B is provided that links the second supply flow path 712B and the second circulation flow path 722B. Thus, the ink 68 can be circulated via the second supply flow path 712A, the bypass flow path 801A, and the second circulation flow path 722A, and the ink 68 can be circulated via the second supply flow path 712B, the bypass flow path 801B, and the second circulation flow path 722B (refer to FIG. 22). As a result, similarly to the third embodiment, the possibility of a deterioration in the print quality can be reduced.

The electromagnetic valve 763A that opens and closes the second supply flow path 712A is provided in the second supply flow path 712A. The electromagnetic valve 763B that opens and closes the second supply flow path 712B is provided in the second supply flow path 712B. The electromagnetic valve 766A that opens and closes the second circulation flow path 722A is provided in the second circulation flow path 722A. The electromagnetic valve 766B that opens and closes the second circulation flow path 722B is provided in the second circulation flow path 722B. When the circulation of the ink 68 is performed in at least one of the main tank 65 and the sub pouch 8, namely, when the tank-bypass circulation (refer to FIG. 23), the pouch-bypass circulation, and the pouch-tank circulation are performed in the sixth embodiment, the electromagnetic valves 763A, 763B, 766A, and 766B close the second supply flow paths 712A and 712B and the second circulation flow paths 722A and 722B. Thus, the print quality is improved in a similar manner to that of the first embodiment.

The electromagnetic valve 761 that opens and closes the first supply flow path 711 is provided in the first supply flow path 711. The electromagnetic valve 764 that opens and closes the first circulation flow path 721 is provided in the first circulation flow path 721. When the ink 68 is circulated in the second supply flow path 712 and the second circulation flow path 722, the electromagnetic valves 761 and 764 close the first supply flow path 711 and the first circulation flow path 721. Thus, the print quality is improved in a similar manner to that of the third embodiment.

A printer 1G that is the printer 1 according to a seventh embodiment will be explained with reference to FIG. 24 and FIG. 25. In the seventh embodiment, the same reference numerals are assigned to a configuration that is the same as that of the above-described embodiments, and a detailed explanation of the same configuration is omitted.

Figure 24:
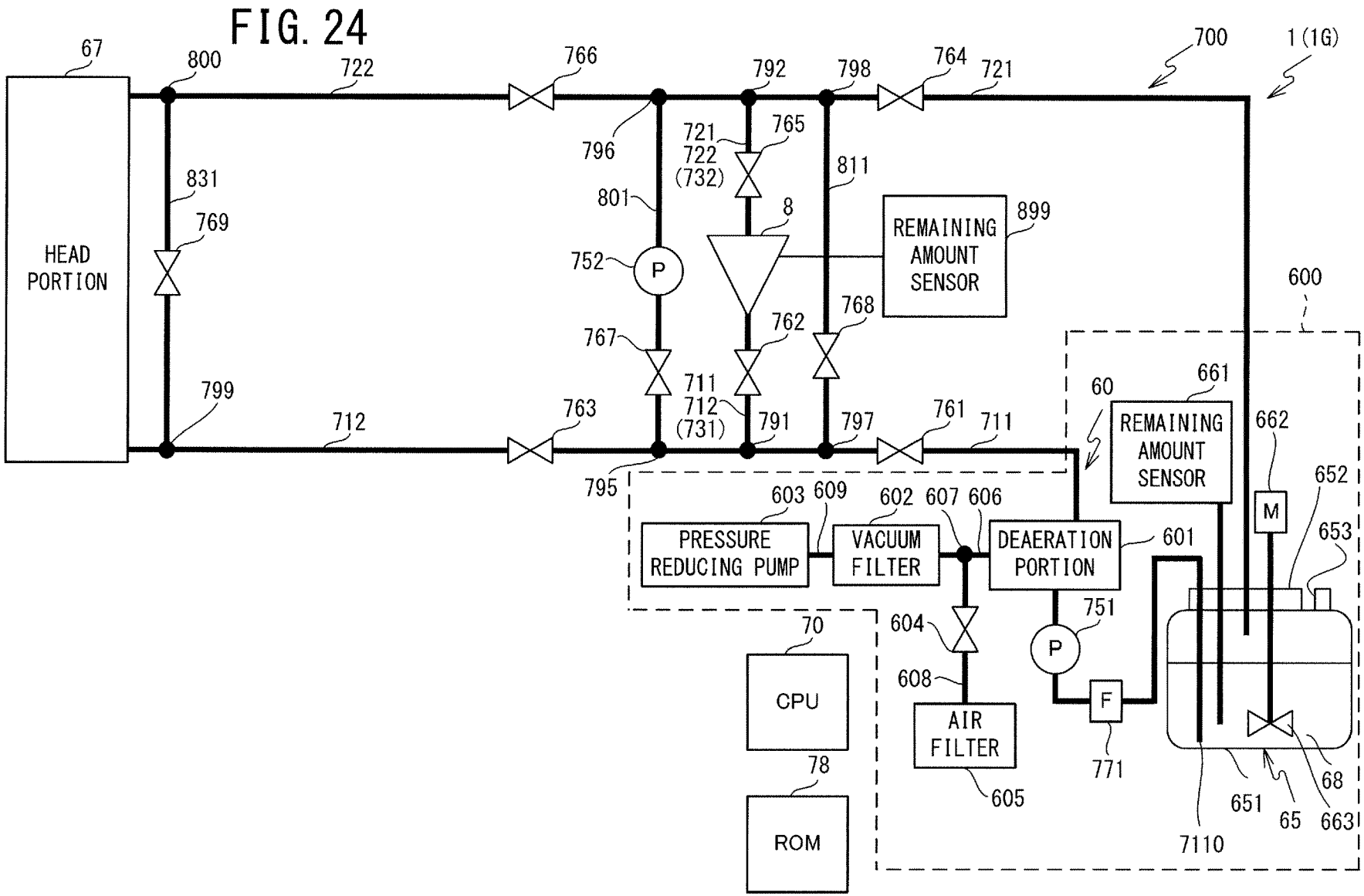
FIG. 24 is a diagram showing flow paths of the ink in the printer.

As shown in FIG. 24, the printer 1G is provided with a bypass flow path 831 and an electromagnetic valve 769, in addition to the configuration of the printer 1E according to the fifth embodiment (refer to FIG. 18). The bypass flow path 831 links the second supply flow path 712 and the second circulation flow path 722. The electromagnetic valve 769 is provided in the bypass flow path 831. The electromagnetic valve 769 opens and closes the bypass flow path 831 in accordance with the control of the CPU 70.

The bypass flow path 831 and the second supply flow path 712 are connected at a ninth connection portion 799. The ninth connection portion 799 is provided between the electromagnetic valve 763 and the head portion 67. More specifically, the ninth connection portion 799 is provided immediately before the head portion 67, on a path that reaches the head portion 67 from the electromagnetic valve 763 in the second supply flow path 712.

The bypass flow path 831 and the second circulation flow path 722 are connected at a tenth connection portion 800. The tenth connection portion 800 is provided between the electromagnetic valve 766 and the head portion 67. More specifically, the tenth connection portion 800 is provided immediately before the head portion 67, on a path that reaches the head portion 67 from the electromagnetic valve 766 in the second circulation flow path 722.

A case will be explained in which the circulation is performed via the second supply flow path 712, the second circulation flow path 722, and the bypass flow path 831. In the following explanation, the circulation of the ink 68 via the bypass flow path 831 is referred to as "bypass circulation."

Figure 25:
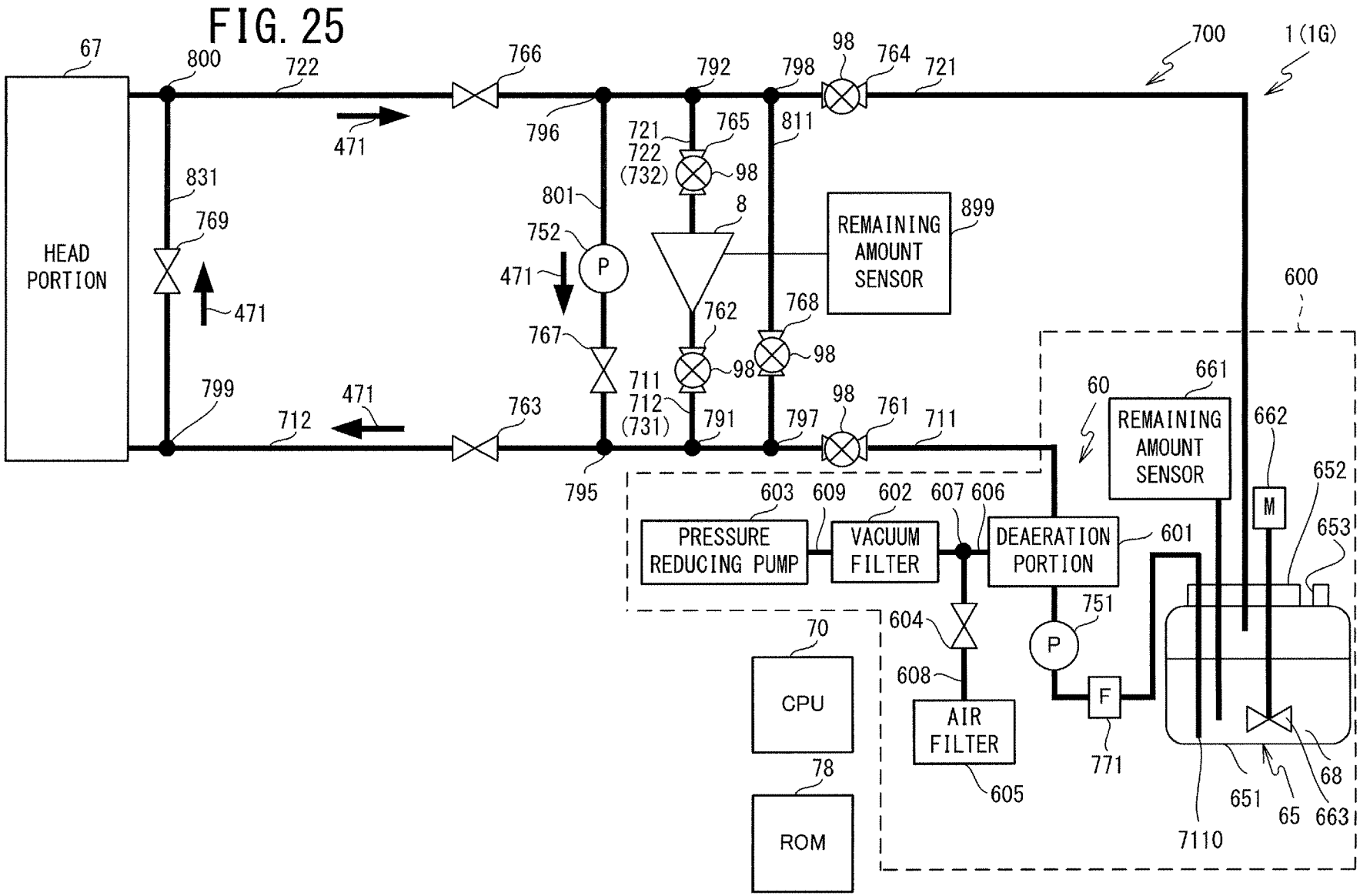
FIG. 25 is a diagram showing a state in which bypass circulation is performed in the printer.

As shown in FIG. 25, when the bypass circulation is performed, the CPU 70 opens the electromagnetic valves 763, 766, 767, and 769, and closes the electromagnetic valves 761, 762, 764, 765, and 768. The pump 752 operates in accordance with the control of the CPU 70. In this way, the ink 68 is circulated in the bypass flow path 801, the second supply flow path 712, the bypass flow path 831, and the second circulation flow path 722 (refer to arrows 471). The bypass flow path 831 is thicker than the flow path inside the head portion 67. Thus, the ink 68 flows more easily to the bypass flow path 831 than to the head portion 67 side. As a result, the ink 68 is circulated, not in the head portion 67, but in the bypass flow path 801, the second supply flow path 712, the bypass flow path 831, and the second circulation flow path 722.

The flow of the ink 68 apart from in the bypass circulation is the same as in the case of the printer 1E (refer to FIG. 18 to FIG. 20), and the same effects are achieved. Therefore, a detailed explanation is omitted. Note that when the flow of the ink 68 apart from the bypass circulation arises, the electromagnetic valve 769 is closed.

In the seventh embodiment, as a result of the bypass circulation, the ink 68 can be circulated in the second supply flow path 712 and the second circulation flow path 722 while reducing a possibility of the ink 68 flowing to the head portion 67 side. Thus, the possibility can be reduced of the meniscus of the ink 68 being damaged in the head portion 67.

A printer 1H that is the printer 1 according to an eighth embodiment will be explained with reference to FIG. 26 and FIG. 27. In the eighth embodiment, the same reference numerals are assigned to a configuration that is the same as that of the above-described embodiments, and a detailed explanation of the same configuration is omitted.

Figure 26:
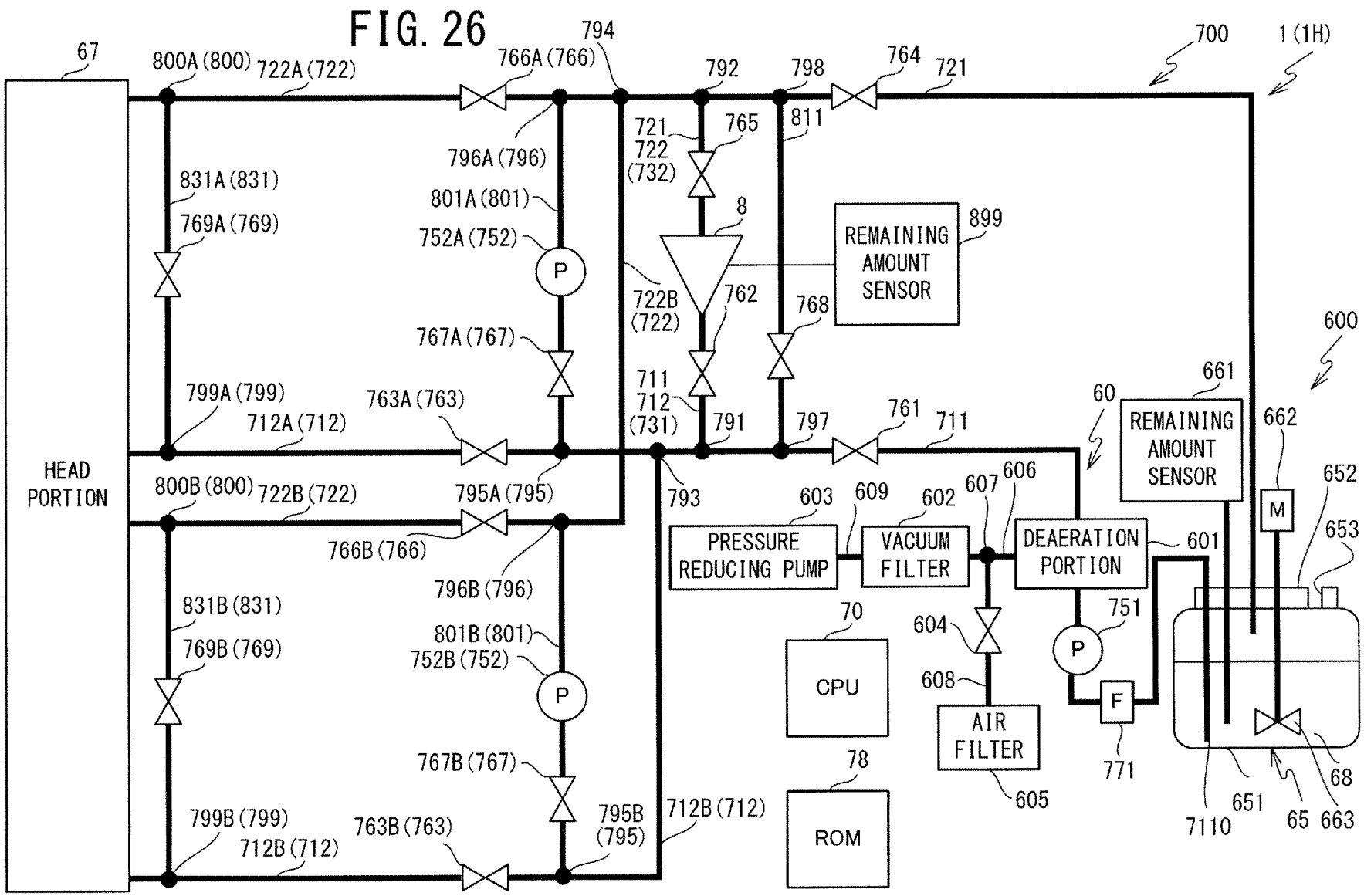
FIG. 26 is a diagram showing flow paths of the ink in the printer.

As shown in FIG. 26, the printer 1H is provided with two of the bypass flow paths 831, two of the electromagnetic valves 769, two of the ninth connection portions 799, and two of the tenth connection portions 800, in addition to the configuration of the printer 1F according to the sixth embodiment (refer to FIG. 21). In the following explanation, of the two bypass flow paths 831, one is referred to as a bypass flow path 831A and the other is referred to as a bypass flow path 831B. Of the two electromagnetic valves 769, one is referred to as an electromagnetic valve 769A and the other is referred to as an electromagnetic valve 769B. Of the two ninth connection portions 799, one is referred to as a ninth connection portion 799A and the other is referred to as a ninth connection portion 799B. Of the two tenth connection portions 800, one is referred to as a tenth connection portion 800A and the other is referred to as a tenth connection portion 800B.

The bypass flow path 831A links the second supply flow path 712A and the second circulation flow path 722A. The electromagnetic valve 769A is provided in the bypass flow path 831A. The electromagnetic valve 769A opens and closes the bypass flow path 831A in accordance with the control of the CPU 70. The bypass flow path 831A and the second supply flow path 712A are connected at the ninth connection portion 799A. The ninth connection portion 799A is provided between the electromagnetic valve 763A and the head portion 67. More specifically, the ninth connection portion 799A is provided immediately before the head portion 67, on a path that reaches the head portion 67 from the electromagnetic valve 763A in the second supply flow path 712A.

The bypass flow path 831A and the second circulation flow path 722A are connected at the tenth connection portion 800A. The tenth connection portion 800A is provided between the electromagnetic valve 766A and the head portion 67. More specifically, the tenth connection portion 800A is provided immediately before the head portion 67, on a path that reaches the head portion 67 from the electromagnetic valve 766A in the second supply flow path 712A.

The bypass flow path 831B links the second supply flow path 712B and the second circulation flow path 722B. The electromagnetic valve 769B is provided in the bypass flow path 831B. The electromagnetic valve 769B opens and closes the bypass flow path 831B in accordance with the control of the CPU 70. The bypass flow path 831B and the second supply flow path 712B are connected at the ninth connection portion 799B. The ninth connection portion 799B is provided between the electromagnetic valve 763B and the head portion 67. More specifically, the ninth connection portion 799B is provided immediately before the head portion 67, on a path that reaches the head portion 67 from the electromagnetic valve 763B in the second supply flow path 712B.

The bypass flow path 831B and the second circulation flow path 722B are connected at the tenth connection portion 800B. The tenth connection portion 800B is provided between the electromagnetic valve 766B and the head portion 67. More specifically, the tenth connection portion 800B is provided immediately before the head portion 67, on a path that reaches the head portion 67 from the electromagnetic valve 766B in the second supply flow path 722B.

A case will be explained in which the bypass circulation is performed. In the eighth embodiment, there is a case in which first bypass circulation is performed, via the bypass flow path 831A (refer to FIG. 27), and a case in which second bypass circulation is performed, via the bypass flow path 831B.

Figure 27:
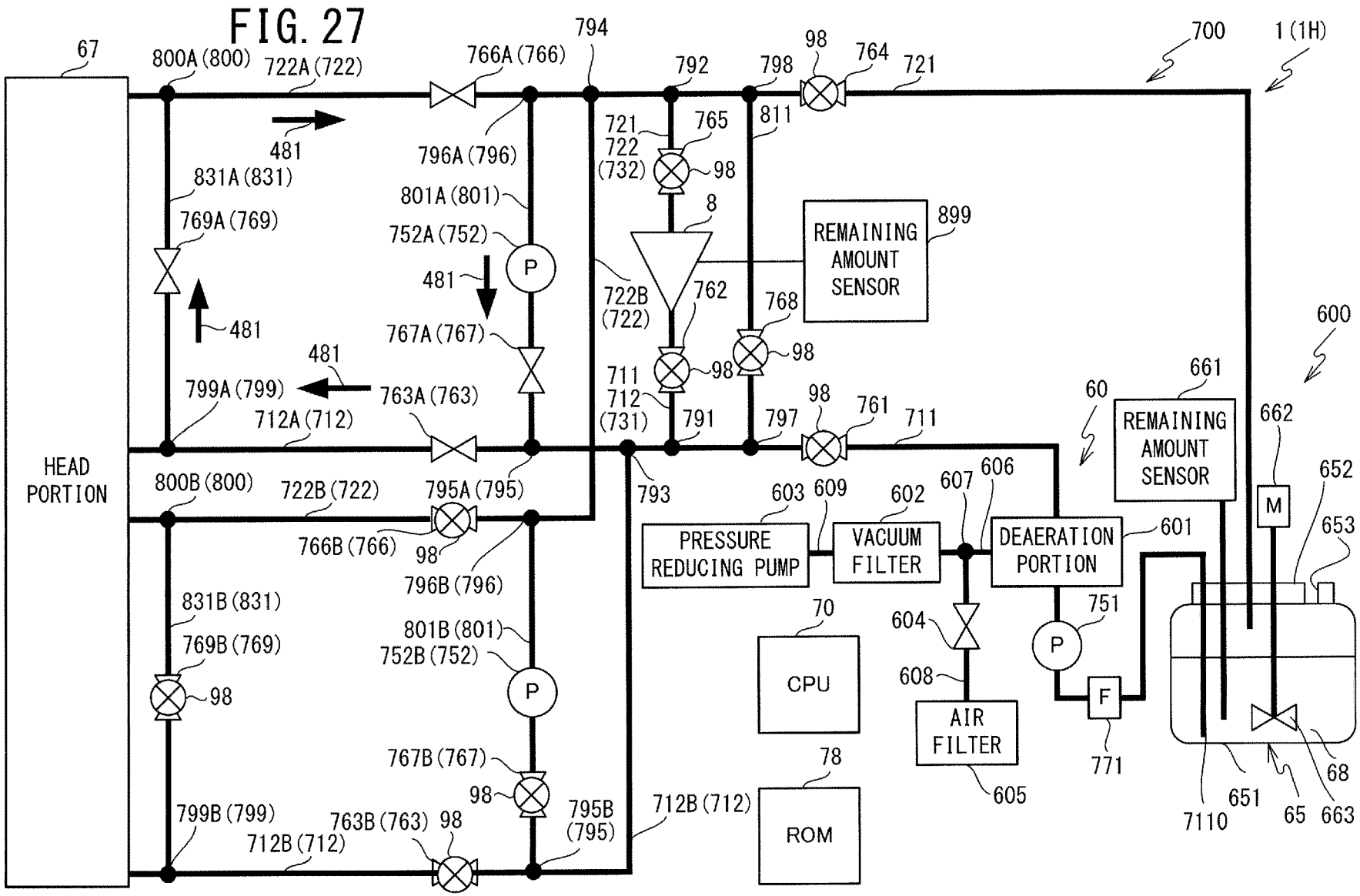
FIG. 27 is a diagram showing a state in which the bypass circulation is performed in the printer.

As shown in FIG. 27, when the first bypass circulation is performed, the CPU 70 opens the electromagnetic valves 763A, 766A, 767A, and 769A, and closes the electromagnetic valves 761, 762, 763B, 764, 765, 766B, 767B, 768, and 769B. The pump 752A operates in accordance with the control of the CPU 70. In this way, the ink 68 is circulated in the bypass flow path 801A, the second supply flow path 712A, the bypass flow path 831A, and the second circulation flow path 722A (refer to arrows 481).

Although not shown in the drawings, when the second bypass circulation is performed, the CPU 70 opens the electromagnetic valves 763B, 766B, 767B, and 769B, and closes the electromagnetic valves 761, 762, 763A, 764, 765, 766A, 767A, 768, and 769A. The pump 752B operates in accordance with the control of the CPU 70. In this way, the ink 68 is circulated in the bypass flow path 801B, the second supply flow path 712B, the bypass flow path 831B, and the second circulation flow path 722B.

The flow of the ink 68 apart from in the bypass circulation is the same as in the case of the printer 1F (refer to FIG. 21 to FIG. 23), and the same effects are achieved. Therefore, a detailed explanation is omitted. Note that when the flow of the ink 68 apart from the bypass circulation arises, the electromagnetic valves 769A and 769B are closed.

In the eighth embodiment, as a result of the bypass circulation, the ink 68 can be circulated in the second supply flow paths 712A and 712B, and the second circulation flow paths 722A and 722B while reducing the possibility of the ink 68 flowing to the head portion 67 side. Thus, the possibility can be reduced of the meniscus of the ink 68 being damaged in the head portion 67.

The present disclosure is not limited to the above-described embodiments, and various modifications are possible. For example, of the two of the bypass flow paths 801 and 811, only one of the bypass flow paths 801 and 811 may be provided. The sub pouch 8 is bag-shaped but may be a different container than the bag shape. The configuration of the deaeration module 60 may be a different configuration than that of the above-described embodiments. The deaeration module 60 may not be provided.

The filter 771 may not be provided. The remaining amount sensors 661 and 899 may not be provided. The motor 662 and the rotating portion 663 may not be provided. It is sufficient that at least some of the electromagnetic valves 761 to 769 be provided. It is sufficient that the electromagnetic valves 761 to 769 be opening and closing portions that open and close the flow paths, and the electromagnetic valves 761 to 769 may be another type of valve. The main tank 65 may be included in the printer 1 or may be provided separately to the printer 1. Of the circulation of the ink 68, some of the circulation methods may not be implemented.

In the above-described embodiments, the second supply flow path 712 and the first supply flow path 711 merge at the first connection portion 791. The second circulation flow path 722 and the first circulation flow path 721 merge at the second connection portion 792. However, one of the second supply flow path 712 and the second circulation flow path 722, and the first supply flow path 711 may merge at the first connection portion 791 or at the sub pouch 8. The other of the second supply flow path 712 and the second circulation flow path 722, and the first circulation flow path 721 may merge at the second connection portion 792 or at the sub pouch 8.

Figure 28:
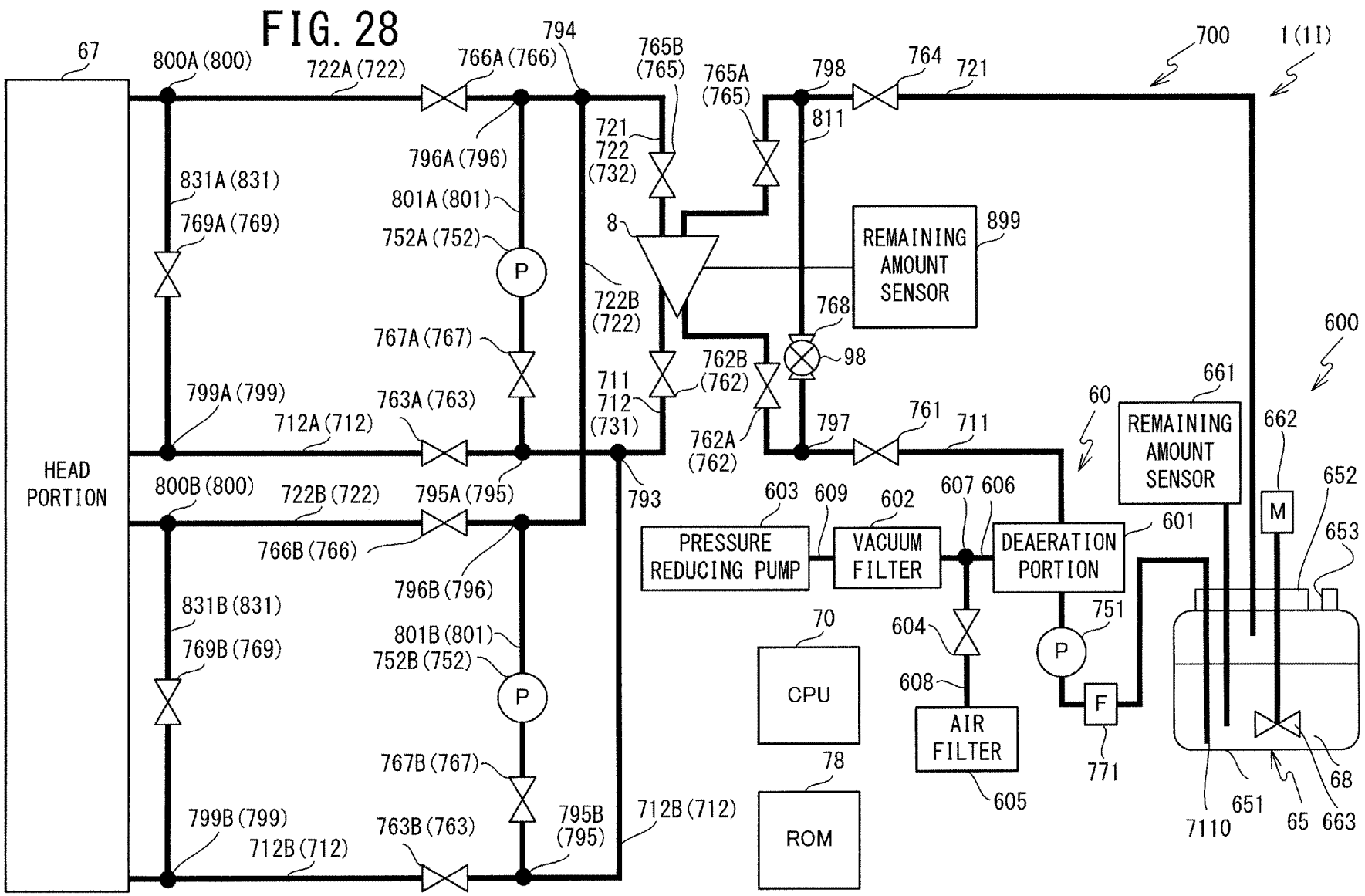
FIG. 28 is a diagram showing a flow path of the ink in the printer.

For example, as shown in FIG. 28, a printer 1I is a modified example of the printer 1H (refer to FIG. 26), and the second supply flow path 712 and the first supply flow path 711 merge at the sub pouch 8, and the second circulation flow path 722 and the first circulation flow path 721 merge at the sub pouch 8. In other words, the first connection portion 791, the second connection portion 792, the first connecting flow path 731, and the second connecting flow path 732 of the above-described embodiments are not provided. The electromagnetic valves 762 are respectively provided in the first supply flow path 711 and the second supply flow path 712. The electromagnetic valves 765 are respectively provided in the first circulation flow path 721 and the second circulation flow path 722.

In the following explanation, the electromagnetic valve 762 provided in the first supply flow path 711 is sometimes referred to as an electromagnetic valve 762A, and the electromagnetic valve 762 provided in the second supply flow path 712 is sometimes referred to as an electromagnetic valve 762B. The electromagnetic valve 765 provided in the first circulation flow path 721 is sometimes referred to as an electromagnetic valve 765A, and the electromagnetic valve 765 provided in the second circulation flow path 722 is sometimes referred to as an electromagnetic valve 765B.

Apart from the above configuration of the printer 1I, the configuration is the same as that of the printer 1H (refer to FIG. 26) and a detailed explanation of the same configuration is omitted. The flow of the ink 68 is also the same as in the printer 1H and the same effects are achieved. When the ink 68 flows in the first supply flow path 711, the electromagnetic valve 762A is opened. When the ink 68 flows in the second supply flow path 712, the electromagnetic valve 762B is opened. When the ink 68 flows in the first circulation flow path 721, the electromagnetic valve 765A is opened, and when the ink 68 flows in the second circulation flow path 722, the electromagnetic valve 765B is opened.

Although not shown in the drawings, in the printers 1A to 1G also, the second supply flow path 712 and the first supply flow path 711 may merge at the sub pouch 8, and the second circulation flow path 722 and the first circulation flow path 721 may merge at the sub pouch 8, in a similar manner. In this case also, the same effects as each of the above-described embodiments are achieved.

Figure 29:
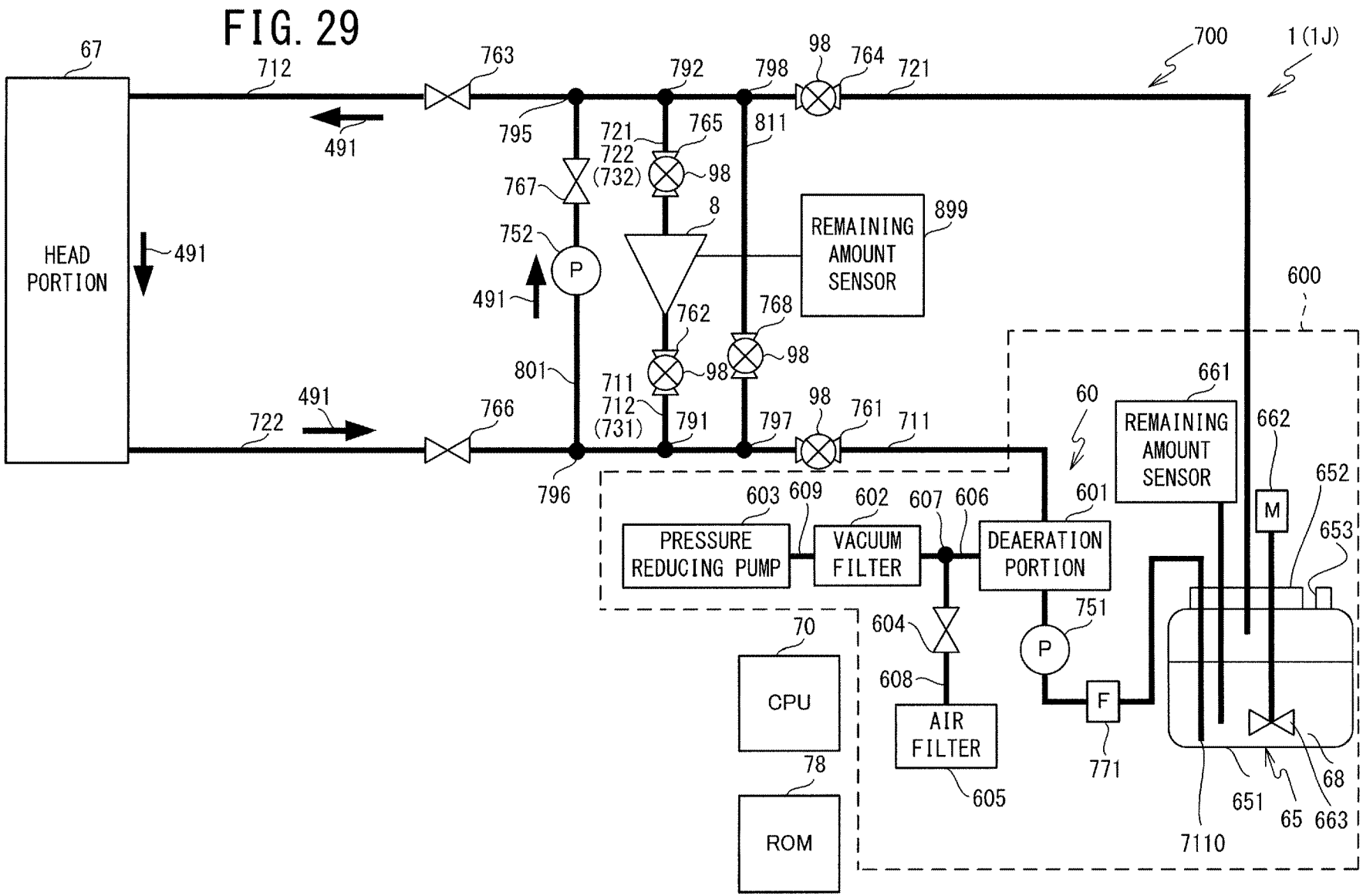
FIG. 29 is a diagram showing a state in which the head-bypass circulation is performed in the printer.

As shown in FIG. 29, a printer 1J is a modified example of the printer 1E (refer to FIG. 18), and the second circulation flow path 722 and the first supply flow path 711 merge at the first connection portion 791, and the second supply flow path 712 and the first circulation flow path 721 merge at the second connection portion 792. In other words, the second supply flow path 712 and the second circulation flow path 722 of the printer 1E are switched over. The pump 752 causes the ink 68 to flow from the sixth connection portion 796 to the fifth connection portion 795 side. The electromagnetic valve 767 is provided between the pump 752 and the fifth connection portion 795.

As shown in FIG. 29, when the head-bypass circulation is performed in the printer 1J, the ink 68 is circulated in the second supply flow path 712, the head portion 67, the second circulation flow path 722, and the bypass flow path 801 (refer to arrows 491).

Although not shown in the drawings, in the printers 1A to 1D and 1F to 1H also, the second circulation flow path 722 and the first supply flow path 711 may merge at the first connection portion 791, and the second supply flow path 712 and the first circulation flow path 721 may merge at the second connection portion 792, in a similar manner. In this case also, the same effects as each of the above-described embodiments are achieved. In the printer 1I also (refer to FIG. 28), the second supply flow path 712 and the second circulation flow path 722 in the printer 1I may be switched over. In this case, the second circulation flow path 722 and the first supply flow path 711 merge at the sub pouch 8, and the first circulation flow path 721 and the second supply flow path 712 merge at the sub pouch 8.

In each of the above-described embodiments, the ink 68 is circulated in all the flow paths included in the printer 1. Thus, in comparison to a case in which the ink 68 is not circulated in some of the flow paths, the possibility can be reduced of a deterioration in the print quality resulting from the sedimentation of the components of the ink 68.

In the fifth embodiment, the head-bypass circulation, and the pouch-tank circulation are simultaneously performed, and the head-bypass circulation and the tank-bypass circulation are simultaneously performed, and this may also be implemented as appropriate in each of the above-described embodiments. In this way, the printer 1 achieves the same effects as those of the fifth embodiment.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A printer comprising:

a first storage configured to be supplied with ink from a second storage that stores the ink, and configured to store the supplied ink;

a head configured to eject the ink supplied from the first storage;

a first supply flow path configured to supply the ink from the second storage to the first storage;

a first circulation flow path configured to circulate the ink to the second storage;

a second supply flow path configured to supply the ink from the first storage to the head;

a second circulation flow path configured to circulate the ink from the head;

a first bypass flow path configured to connect the second supply flow path and the second circulation flow path;

a processor; and a memory storing computer-readable instructions which, when executed by the processor, simultaneously perform processes including:

second storage circulation via the second storage, the first supply flow path, and the first circulation flow path; and head circulation via the head, the second supply flow path, the second circulation flow path, and the first bypass flow path.

2. The printer according to claim 1, further comprising a second bypass flow path configured to link the first supply flow path and the first circulation flow path.

3. The printer according to claim 1, wherein the first bypass flow path is provided plurality.

4. The printer according to claim 3, wherein the computer-readable instructions, when executed by the processor, further perform process including:

performing circulation process via the second supply flow path, second circulation flow path, and the plurality of the first bypass flow path.

5. A printer comprising:

a first storage configured to be supplied with ink from a second storage that stores the ink, and configured to store the supplied ink;

a head configured to eject the ink supplied from the first storage;

a first supply flow path configured to supply the ink from the second storage to the first storage;

a first circulation flow path configured to circulate the ink from the first storage to the second storage;

a second supply flow path configured to supply the ink from the first storage to the head; and a second circulation flow path configured to circulate the ink from the head, wherein the first supply flow path merges with one of the second supply flow path and the second circulation flow path at one of a first connector and the first storage, and the first circulation flow path merges with the other of the second supply flow path and the second circulation flow path at one of a second connector and the first storage, the printer further comprises:

first valve provided in the second supply flow path, and configured to open and close the second supply flow path;

second valve provided in the second circulation flow path, and configured to open and close the second circulation flow path;

a first bypass flow path configured to link the first supply flow path and the first circulation flow path;

a processor; and a memory storing computer-readable instructions which, when executed by the processor, perform process including:

closing, by controlling the first valves, the second supply flow path and the second circulation flow path when the circulation of the ink is performed in at least one of the second storage and the first storage.

6. The printer according to claim 5, further comprising a second bypass flow path configured to link the second supply flow path and the second circulation flow path.

7. The printer according to claim 6, wherein the second bypass flow path is provided plurality.

8. The printer according to claim 7, wherein the computer-readable instructions, when executed by the processor, further perform process including:

performing circulation process via the second supply flow path, the second circulation flow path, and the plurality of the second bypass flow path.

9. A printer comprising:

a first storage configured to be supplied with ink from a second storage that stores the ink, and configured to store the supplied ink;

a head configured to eject the ink supplied from the first storage;

a first supply flow path configured to supply the ink from the second storage to the first storage;

a first circulation flow path configured to circulate the ink from the first storage to the second storage;

a second supply flow path configured to supply the ink from the first storage to the head; and a second circulation flow path configured to circulate the ink from the head, wherein the first supply flow path merges with one of the second supply flow path and the second circulation flow path at one of a first connector and the first storage, and the first circulation flow path merges with the other of the second supply flow path and the second circulation flow path at one of a second connector and the first storage, the printer further comprises:

first valve provided in the first supply flow path, and configured to open and close the first supply flow path;

second valve provided in the first circulation flow path, and configured to open and close the first circulation flow path;

a processor; and a memory storing computer-readable instructions which, when executed by the processor, perform process including:

closing, by controlling the first valve and the second valve, the first supply flow path and the first circulation flow path when the circulation of the ink is performed in the second supply flow path and the second circulation flow path.

10. The printer according to claim 9, further comprising a first bypass flow path configured to link the first supply flow path and the first circulation flow path.

11. The printer according to claim 9, further comprising a second bypass flow path configured to link the second supply flow path and the second circulation flow path.

12. The printer according to claim 11, wherein the second bypass flow path is provided plurality.

13. The printer according to claim 12, wherein the computer-readable instructions, when executed by the processor, further perform process including:

performing circulation process via the second supply flow path, the second circulation flow path, and the plurality of the second bypass flow path.

* * * * *